US009723890B2

(12) United States Patent
Long et al.

(10) Patent No.: US 9,723,890 B2
(45) Date of Patent: Aug. 8, 2017

(54) ARTICLE OF FOOTWEAR INCORPORATING A KNITTED COMPONENT WITH BODY AND HEEL PORTIONS

(71) Applicant: Nike, Inc., Beaverton, OR (US)

(72) Inventors: Bradley S. Long, Portland, OR (US); Atikom Tappatarnpornsuk, Taichung (TW); Peter R. Savage, Aloha, OR (US)

(73) Assignee: NIKE, Inc., Beaverton, OR (US)

( * ) Notice: Subject to any disclaimer, the term of this patent is extended or adjusted under 35 U.S.C. 154(b) by 119 days.

(21) Appl. No.: 14/087,149

(22) Filed: Nov. 22, 2013

(65) Prior Publication Data

US 2015/0143716 A1 May 28, 2015

(51) Int. Cl.
*A43B 1/04* (2006.01)
*A43B 5/00* (2006.01)
(Continued)

(52) U.S. Cl.
CPC ..... *A43B 1/04* (2013.01); *A43B 5/00* (2013.01); *A43B 7/20* (2013.01); *A43B 23/0205* (2013.01);
(Continued)

(58) Field of Classification Search
CPC ..... A43B 1/04; A43B 23/02; A43B 23/0205; A43B 23/0245; A43B 23/025;
(Continued)

(56) References Cited

U.S. PATENT DOCUMENTS 479,251 A 7/1892 Dodge et al.
601,192 A 3/1898 Woodside
(Continued)

FOREIGN PATENT DOCUMENTS

CN 10335585 A 10/2013
DE 870963 C 3/1953
(Continued)

OTHER PUBLICATIONS

Tamura, Hisayoshi et al., Translation of JP 2005160697, Shoes for Long Distance Running, Jun. 2005.*
(Continued)

*Primary Examiner* — Jameson Collier
*Assistant Examiner* — Heather Mangine
(74) *Attorney, Agent, or Firm* — Brinks Gilson & Lione

(57) ABSTRACT

An article of footwear may include a knitted component formed of multiple knitted component portions. The knitted component includes a body portion and a heel portion. The body portion is formed of unitary knit construction and extends through a forefoot region, a midfoot region, and at least partially into a heel region of the article of footwear. The heel portion is formed of unitary knit construction and extends through the heel region and includes a cuff that defines a throat opening of the upper for receiving a foot. The body portion and the heel portion are joined along adjacent edges to form the knitted component. Knitting directions of the knitted component portions vary along the adjacent edges. An overlay element may also be provided to cover a seam attaching the adjacent edges of the knitted component portions.

19 Claims, 19 Drawing Sheets

(51) Int. Cl.

| | |
|---|---|
| ***A43B 7/00*** | (2006.01) |
| ***A43B 23/02*** | (2006.01) |
| ***A43C 1/00*** | (2006.01) |
| ***A43B 7/20*** | (2006.01) |
| ***D04B 1/22*** | (2006.01) |

(52) U.S. Cl.

CPC ..... *A43B 23/025* (2013.01); *A43B 23/0235* (2013.01); *A43B 23/0245* (2013.01); *A43B 23/0295* (2013.01); *A43C 1/00* (2013.01); *D04B 1/22* (2013.01); *D10B 2403/032* (2013.01); *D10B 2501/043* (2013.01)

(58) Field of Classification Search

CPC ..... A43B 23/0265; A43B 23/00; A43B 5/007; A43B 5/003; A43B 5/12

USPC ..... 36/50.1, 83, 84, 45, 9 R, 95 R, 10, 55, 36/47; 12/146; 66/185

See application file for complete search history.

(56) References Cited

U.S. PATENT DOCUMENTS 1,215,198 A 2/1917 Rothstein
1,597,934 A 8/1926 Stimpson
1,888,172 A 11/1932 Joha
1,902,780 A 3/1933 Holden et al.
1,910,251 A 5/1933 Joha
2,001,293 A 5/1935 Wilson
2,047,724 A 7/1936 Zuckerman
2,147,197 A * 2/1939 Glidden ..... A43B 1/02 36/3 A
2,314,098 A 3/1943 McDonald
2,330,199 A 9/1943 Basch
2,343,390 A 3/1944 Ushakoff
2,400,692 A 5/1946 Herbert
2,440,393 A 4/1948 Clark
2,569,764 A 10/1951 Jonas
2,586,045 A 2/1952 Hoza
2,608,078 A 8/1952 Anderson
2,641,004 A 6/1953 Whiting et al.
2,675,631 A 4/1954 Doughty
2,994,322 A 8/1961 Cullen et al.
3,583,081 A 6/1971 Hayashi
3,694,940 A 10/1972 Stohr
3,704,474 A 12/1972 Winkler
3,766,566 A 10/1973 Tadokoro
3,778,856 A 12/1973 Christie et al.
3,952,427 A 4/1976 Von den Benken et al.
3,972,086 A 8/1976 Belli et al.
4,027,402 A 6/1977 Liu et al.
4,031,586 A 6/1977 Von den Benken et al.
4,211,806 A 7/1980 Civardi et al.
4,232,458 A 11/1980 Bartels
4,255,949 A 3/1981 Thorneburg
4,258,480 A 3/1981 Famolare, Jr.
4,317,292 A 3/1982 Melton
4,373,361 A 2/1983 Thorneburg
4,447,967 A 5/1984 Zaino
4,465,448 A 8/1984 Aldridge
4,538,367 A * 9/1985 Adams ..... A43C 1/00 24/714.6
4,607,439 A 8/1986 Sogabe et al.
4,662,088 A * 5/1987 Autry ..... A43B 23/0235 36/105
4,727,660 A * 3/1988 Bernhard ..... A43B 7/00 36/110
4,737,396 A 4/1988 Kamat
4,750,339 A 6/1988 Simpson et al.
4,756,098 A 7/1988 Boggia
D297,882 S * 10/1988 Tong ..... D2/970
4,785,558 A 11/1988 Shiomura
4,813,158 A 3/1989 Brown
5,031,423 A 7/1991 Ikenaga
5,095,720 A 3/1992 Tibbals, Jr.
5,117,567 A 6/1992 Berger
5,152,025 A 10/1992 Hirmas
5,192,601 A 3/1993 Neisler
5,243,772 A * 9/1993 Francis ..... A43B 5/00 36/106
5,345,638 A 9/1994 Nishida
5,353,524 A 10/1994 Brier
5,355,596 A * 10/1994 Sussmann ..... A43C 11/22 36/45
5,365,677 A * 11/1994 Dalhgren ..... A43B 1/04 36/3 A
5,371,957 A 12/1994 Gaudio
5,461,884 A 10/1995 McCartney et al.
5,511,323 A 4/1996 Dahlgren
5,533,279 A * 7/1996 Mitsui ..... A43B 5/00 36/45
5,572,860 A 11/1996 Mitsumoto et al.
5,575,090 A 11/1996 Condini
5,623,840 A 4/1997 Roell
5,729,918 A 3/1998 Smets
5,735,145 A 4/1998 Pernick
5,746,013 A 5/1998 Fay, Sr.
5,765,296 A 6/1998 Ludemann et al.
5,884,419 A 3/1999 Davidowitz et al.
5,996,189 A 12/1999 Wang
6,029,376 A 2/2000 Cass
6,032,387 A 3/2000 Johnson
6,052,921 A 4/2000 Oreck
6,088,936 A 7/2000 Bahl
6,151,802 A 11/2000 Reynolds
6,170,175 B1 1/2001 Funk
6,237,251 B1 * 5/2001 Litchfield ..... A43B 1/0072 36/114
6,308,438 B1 10/2001 Throneburg et al.
6,333,105 B1 12/2001 Tanaka et al.
6,401,364 B1 6/2002 Burt
6,444,074 B1 * 9/2002 Marega ..... A43C 1/00 12/142 LC
6,558,784 B1 5/2003 Norton et al.
6,588,237 B2 7/2003 Cole et al.
6,754,983 B2 6/2004 Hatfield et al.
6,910,288 B2 6/2005 Dua
6,922,917 B2 8/2005 Kerns et al.
6,931,762 B1 * 8/2005 Dua ..... A43B 1/04 12/142 G
6,944,971 B2 * 9/2005 Delgorgue ..... A43B 1/0072 36/4
D517,297 S 3/2006 Jones et al.
7,051,460 B2 5/2006 Orei et al.
7,056,402 B2 6/2006 Koerwien et al.
7,347,011 B2 3/2008 Dua et al.
7,392,601 B2 * 7/2008 Vattes ..... A41D 27/28 36/10
7,441,348 B1 10/2008 Dawson
7,543,397 B2 6/2009 Kilgore et al.
7,568,298 B2 8/2009 Kerns
7,682,219 B2 3/2010 Falla
D628,776 S * 12/2010 Cofinco ..... D2/908
8,429,835 B2 * 4/2013 Dojan ..... A43B 1/04 36/3 A
8,438,757 B2 * 5/2013 Roser ..... A43C 1/00 36/45
8,490,299 B2 7/2013 Dua et al.
2002/0078599 A1 6/2002 Delgorgue et al.
2002/0148258 A1 10/2002 Cole et al.
2003/0126762 A1 7/2003 Tseng
2003/0191427 A1 10/2003 Jay et al.
2004/0118018 A1 6/2004 Dua
2004/0181972 A1 9/2004 Csorba
2005/0081402 A1 * 4/2005 Orei ..... A43B 1/00 36/45
2005/0115284 A1 6/2005 Dua
2005/0193592 A1 9/2005 Dua et al.
2005/0273988 A1 12/2005 Christy
2005/0284000 A1 12/2005 Kerns
2006/0059715 A1 3/2006 Aveni
2006/0162187 A1 7/2006 Byrnes et al.

(56) References Cited

U.S. PATENT DOCUMENTS

| | | | | |
|---|---|---|---|---|
| 2007/0022627 | A1 | 2/2007 | Sokolowski et al. | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0110049 | A1* | 5/2008 | Sokolowski | A43B 3/0031 36/50.1 |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0024254 | A1* | 2/2010 | Combs | A43B 7/125 36/3 A |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0263236 | A1* | 10/2010 | Carboy | A43B 1/0072 36/117.1 |
| 2011/0030244 | A1 | 2/2011 | Motawi et al. | |
| 2011/0078921 | A1 | 4/2011 | Greene et al. | |
| 2011/0265347 | A1* | 11/2011 | Leary | A42C 2/007 36/93 |
| 2012/0144698 | A1* | 6/2012 | Mcdowell | B29D 35/146 36/45 |
| 2012/0233882 | A1 | 9/2012 | Huffa et al. | |
| 2012/0255201 | A1 | 10/2012 | Little | |
| 2013/0174443 | A1* | 7/2013 | Mankowski | A43B 7/34 36/10 |
| 2014/0115928 | A1* | 5/2014 | Pelletier, Jr. | A43B 5/0401 36/116 |
| 2016/0058099 | A1* | 3/2016 | Panian | A43B 23/0265 36/84 |
| 2016/0095377 | A1* | 4/2016 | Tamm | A43B 3/0036 36/9 R |

FOREIGN PATENT DOCUMENTS

| | | | |
|---|---|---|---|
| DE | 1084173 | | 6/1960 |
| DE | 19738433 | | 4/1998 |
| DE | 19728848 | | 1/1999 |
| EP | 0448714 | | 10/1991 |
| EP | 0728860 | | 8/1996 |
| EP | 0758693 | | 2/1997 |
| EP | 0279950 | A2 | 8/1998 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| EP | 2792265 | | 10/2014 |
| FR | 1109762 | | 2/1956 |
| FR | 2171172 | | 9/1973 |
| GB | 300472 | | 11/1928 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| JP | 2005160697 | | 6/2005 |
| JP | 2005160697 | A * | 6/2005 |
| NL | 7304678 | | 10/1974 |
| WO | 9003744 | | 4/1990 |
| WO | 0032861 | | 6/2000 |
| WO | 0231247 | | 4/2002 |

OTHER PUBLICATIONS

Translation of JP20051600697, Tamura, Hisayoshi et al, JP 2005160697, "Shoes for Long Distance Running", Jun. 23, 2005, translated by Google translation, Sep. 17, 2015.*

International Search Report and Written Opinion mailed Mar. 10, 2015 in International Application No. PCT/US2014/053085.

Letter from Bruce Huffa dated Dec. 23, 2013 (71 Pages).

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 mailed on Apr. 20, 2010.

International Search Report and Written Opinion in connection with PCT/US2012/028576 mailed on Oct. 1, 2012.

International Search Report and Written Opinion in connection with PCT/US2012/028559 mailed on Oct. 19, 2012.

International Search Report and Written Opinion in connection with PCT/US2012/028534 mailed on Oct. 17, 2012.

International Preliminary Report on Patentability in connection with PCT/US2012/028534 mailed Sep. 17, 2013.

International Preliminary Report on Patentability in connection with PCT/US2012/028576 mailed Sep. 17, 2013.

International Preliminary Report on Patentability of PCT/US2014/053085 dated May 24, 2016, 9 pages.

Office Action for corresponding ROC (Taiwan) Application No. 103125367, dated Feb. 1, 2016, 30 pages.

Office Action and English translation of relevant portion of Chinese Application No. 2014800639865, dated Feb. 4, 2017, 9 pages.

* cited by examiner

ARTICLE OF FOOTWEAR INCORPORATING A KNITTED COMPONENT WITH BODY AND HEEL PORTIONS

BACKGROUND

Conventional articles of footwear generally include two primary elements, an upper and a sole structure. The upper is secured to the sole structure and forms a void on the interior of the footwear for comfortably and securely receiving a foot. The sole structure is secured to a lower surface of the upper so as to be positioned between the upper and the ground. In some articles of athletic footwear, for example, the sole structure may include a midsole and an outsole. The midsole may be formed from a polymer foam material that attenuates ground reaction forces to lessen stresses upon the foot and leg during walking, running, and other ambulatory activities. The outsole is secured to a lower surface of the midsole and forms a ground-engaging portion of the sole structure that is formed from a durable and wear-resistant material. The sole structure may also include a sockliner positioned within the void and proximal a lower surface of the foot to enhance footwear comfort.

The upper generally extends over the instep and toe areas of the foot, along the medial and lateral sides of the foot, and around the heel area of the foot. In some articles of footwear, such as basketball footwear and boots, the upper may extend upward and around the ankle to provide support or protection for the ankle. Access to the void on the interior of the upper is generally provided by an opening in a heel region of the footwear. A lacing system is often incorporated into the upper to adjust the fit of the upper, thereby permitting entry and removal of the foot from the void within the upper. The lacing system also permits the wearer to modify certain dimensions of the upper, particularly girth, to accommodate feet with varying dimensions. In addition, the upper may include a tongue that extends under the lacing system to enhance adjustability of the footwear, and the upper may incorporate a heel counter to limit movement of the heel.

Various materials are conventionally used in manufacturing the upper. The upper of athletic footwear, for example, may be formed from multiple material elements. The materials may be selected based upon various properties, including stretch-resistance, wear-resistance, flexibility, air-permeability, compressibility, and moisture-wicking, for example. With regard to an exterior of the upper, the toe area and the heel area may be formed of leather, synthetic leather, or a rubber material to impart a relatively high degree of wear-resistance. Leather, synthetic leather, and rubber materials may not exhibit the desired degree of flexibility and air-permeability for various other areas of the exterior. Accordingly, the other areas of the exterior may be formed from a synthetic textile, for example. The exterior of the upper may be formed, therefore, from numerous material elements that each impart different properties to the upper. An intermediate or central layer of the upper may be formed from a lightweight polymer foam material that provides cushioning and enhances comfort. Similarly, an interior of the upper may be formed of a comfortable and moisture-wicking textile that removes perspiration from the area immediately surrounding the foot. The various material elements and other components may be joined with an adhesive or stitching. Accordingly, the conventional upper is formed from various material elements that each impart different properties to various areas of the footwear.

SUMMARY

In one aspect, the invention provides an article of footwear having an upper and a sole structure secured to the upper, the upper including a knitted component, the knitted component including: a body portion forming a substantial majority of the upper, the body portion extending through a forefoot region, a midfoot region, and at least partially into a heel region of the article of footwear, the body portion being formed of unitary knit construction; and a heel portion forming a portion of the upper that extends above the foot region, the heel portion extending through the heel region and including a cuff that defines a throat opening within the upper for receiving a foot, the heel portion being formed of unitary knit construction; wherein the body portion and the heel portion are joined along adjacent edges extending along each of a medial side and a lateral side of the upper to form the knitted component.

In another aspect, the invention provides an article of footwear having an upper and a sole structure secured to the upper, the upper including a knitted component, the knitted component including: a body portion forming a substantial majority of the upper, the body portion extending through a forefoot region, a midfoot region, and at least partially into a heel region of the article of footwear, the body portion being formed of unitary knit construction with a plurality of courses extending along a first knitting direction; and a heel portion forming a portion of the upper that extends above body portion, the heel portion extending through the heel region and including a cuff that defines a throat opening within the upper for receiving a foot, the heel portion being formed of unitary knit construction with a plurality of courses extending along a second knitting direction; wherein the body portion and the heel portion are joined along adjacent edges extending along each of a medial side and a lateral side of the upper to form the knitted component; and wherein the first knitting direction and the second knitting direction are disposed in different directions at the adjacent edges joining the body portion and the heel portion.

In another aspect, the invention provides an article of footwear having an upper and a sole structure secured to the upper, the upper including a knitted component formed of multiple knitted component portions, the knitted component including: a foot region forming a substantial majority of the upper, the foot region extending through a forefoot region, a midfoot region, and a heel region of the article of footwear, the foot region including an instep area that extends between a medial side and a lateral side of the upper, wherein the foot region includes a body portion of the knitted component and at least a portion of a heel portion of the knitted component; an ankle region forming a portion of the upper that extends above the foot region, the ankle region including a cuff that defines a throat opening for providing access to a void within the upper for receiving a foot, wherein the heel portion of the knitted component comprises a substantial majority of the ankle region; wherein the heel portion of the knitted component is formed of unitary knit construction such that the cuff extends substantially continuously around the heel region of the upper between the medial side and the lateral side; and wherein the body portion and the heel portion are joined along adjacent edges to form the knitted component.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
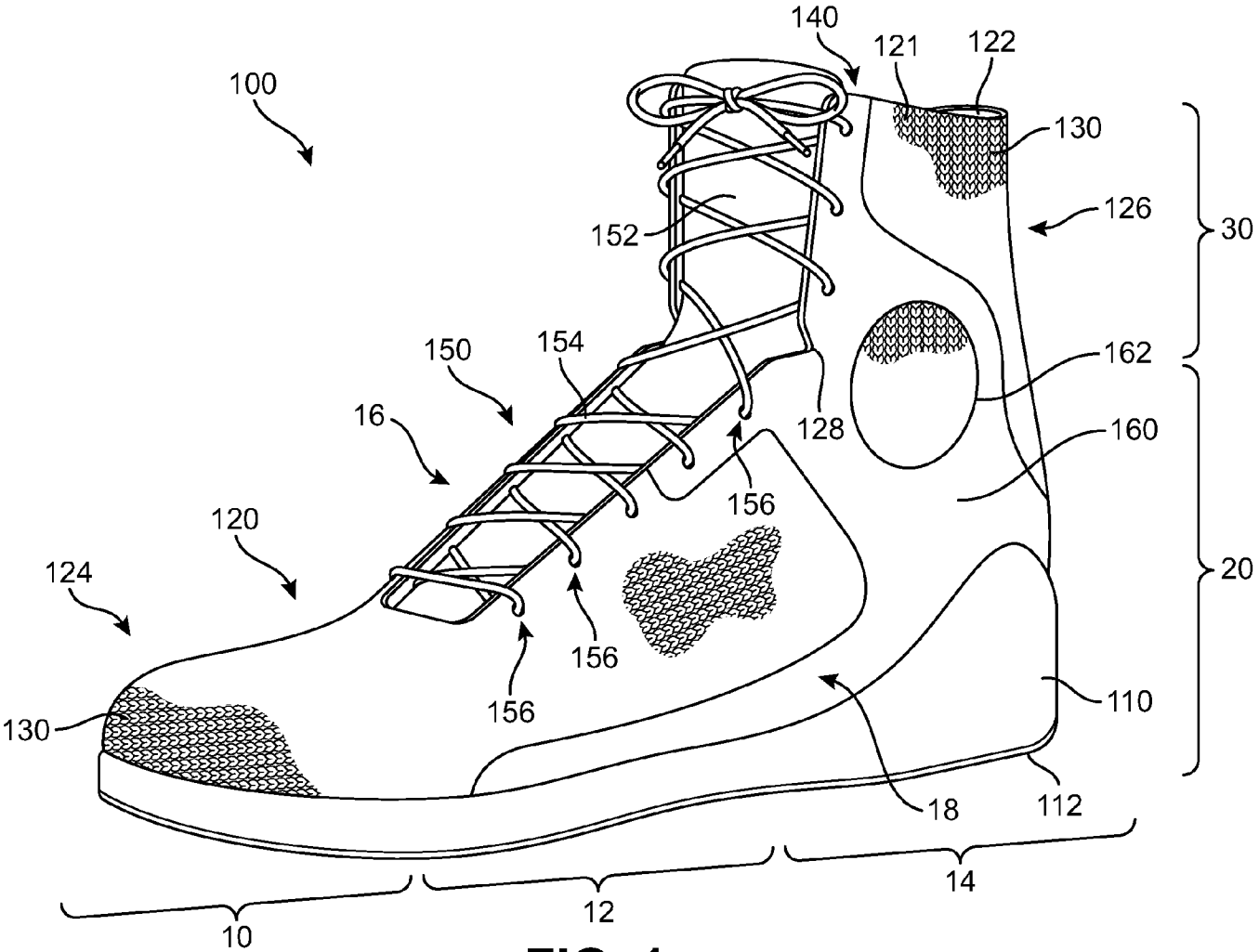
FIG. 1 is an isometric view of an exemplary embodiment of an article of footwear.

The following discussion and accompanying figures disclose a variety of concepts relating to knitted components and the manufacture of knitted components. Although the knitted components may be used in a variety of products, an article of footwear that incorporates one of the knitted components is disclosed below as an example. FIGS. 1 through 17 illustrate an exemplary embodiment of an article of footwear incorporating a knitted component including multiple portions. The individual features of the knitted component as described herein may be used in combination or may be provided separately in different configurations for articles of footwear. In addition, any of the features may be optional and may not be included in any one particular embodiment of a knitted component.

For consistency and convenience, directional adjectives are employed throughout this detailed description corresponding to the illustrated embodiments. The term "longitudinal" as used throughout this detailed description and in the claims refers to a direction extending a length or major axis of an article. In some cases, the longitudinal direction may extend from a forefoot region to a heel region of the article. Also, the term "lateral" as used throughout this detailed description and in the claims refers to a direction extending a width or minor axis of an article. In other words, the lateral direction may extend between a medial side and a lateral side of an article. Furthermore, the term "vertical" as used throughout this detailed description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, including an upper, a knitted component and portions thereof, and/or a sole structure.

FIGS. 1 through 5 illustrate an exemplary embodiment of an article of footwear 100, also referred to simply as article 100. In some embodiments, article of footwear 100 may include a sole structure 110 and an upper 120. Although article 100 is illustrated as having a general configuration suitable for basketball, concepts associated with article 100 may also be applied to a variety of other athletic footwear types, including baseball shoes, soccer shoes, cycling shoes, football shoes, tennis shoes, running shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

Figure 2:
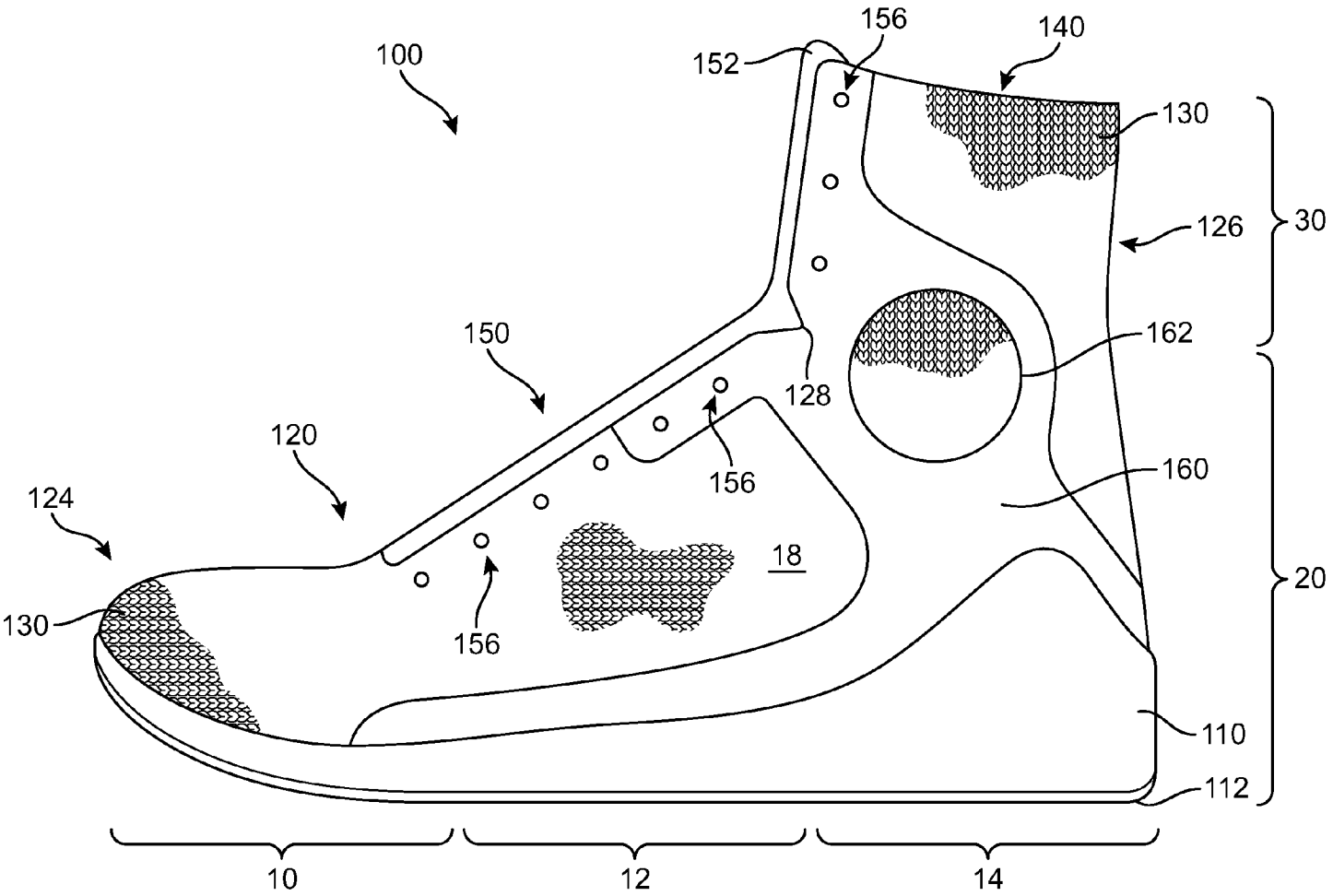
FIG. 2 is a medial side view of an exemplary embodiment of an article of footwear.
Figure 3:
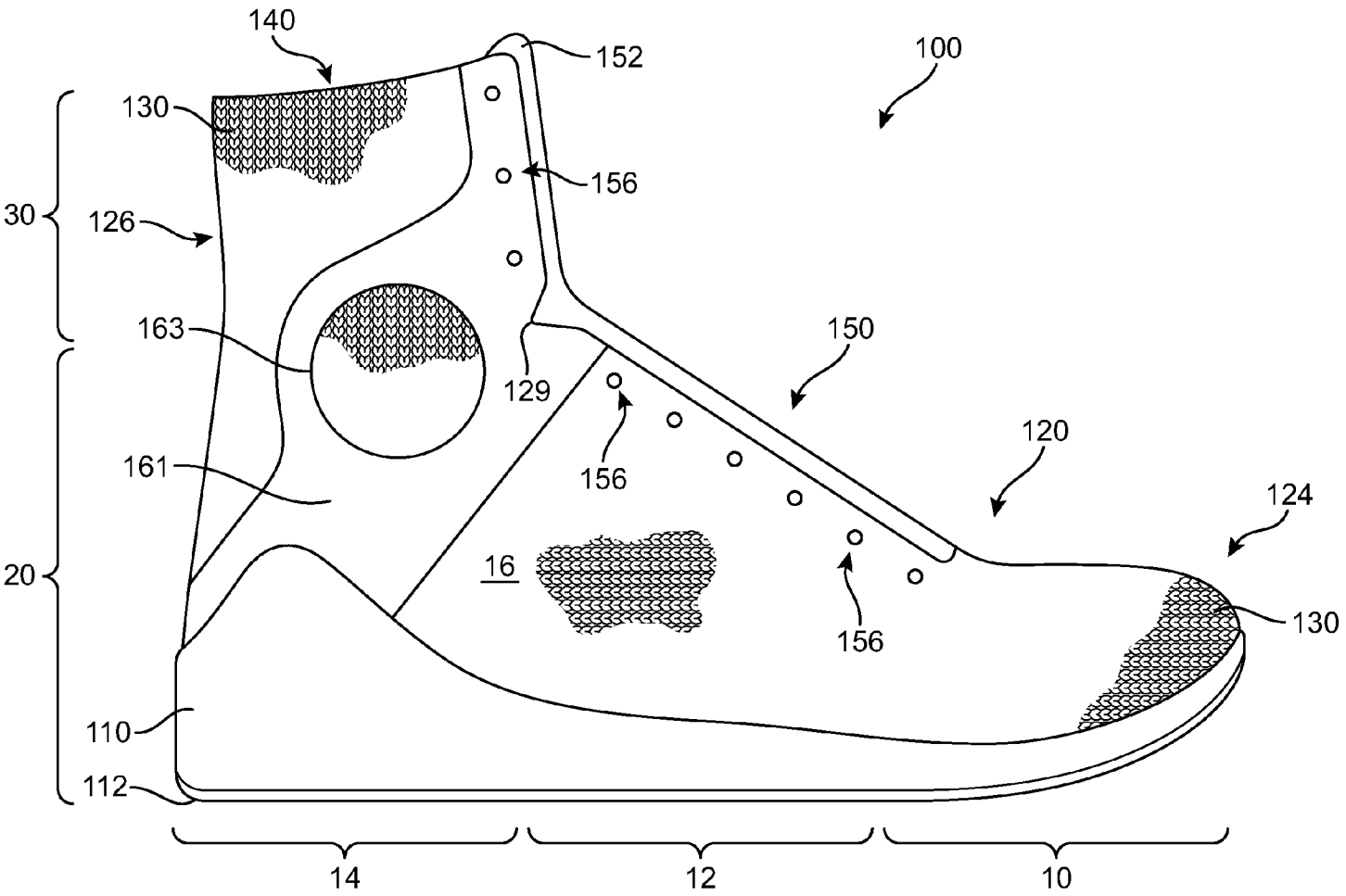
FIG. 3 is a lateral side view of an exemplary embodiment of an article of footwear.

For reference purposes, article 100 may be divided into three general regions: a forefoot region 10, a midfoot region 12, and a heel region 14, as shown in FIGS. 1, 2, and 3. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. In some embodiments, sole structure 110 may include one or more components, including a midsole, an outsole, and/or a sockliner or insole. In an exemplary embodiment, sole structure 110 may include an outsole 112 that is secured to a lower surface of upper 120 and/or a base portion configured for securing sole structure 110 to upper 120. In one embodiment, outsole 112 may be formed from a wear-resistant rubber material that is textured to impart traction. In this embodiment, outsole 112 is configured to provide traction suitable for use on a basketball court. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

For example, in other embodiments, sole structure 110 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, upper 120 defines a void within article 100 for receiving and securing a foot relative to sole structure 110. The void is shaped to accommodate the foot and extends along a lateral side of the foot, along a medial side of the foot, over the foot, around the heel, and under the foot. Upper 120 includes an exterior surface 121 and an opposite interior surface 122. Whereas exterior surface 121 faces outward and away from article 100, interior surface 122 faces inward and defines a majority or a relatively large portion of the void within article 100 for receiving the foot. Moreover, interior surface 122 may lay against the foot or a sock covering the foot. Access to the void is provided by a throat opening 140 located in at least heel region 14. More particularly, the foot may be inserted into upper 120 through throat opening 140, and the foot may be withdrawn from upper 120 through throat opening 140. In some embodiments, an instep area 150 extends from ankle opening 140 in heel region 14 over an area corresponding to an instep of the foot to an area adjacent to forefoot region 10.

A lace 154 extends through a plurality of lace apertures 156 in upper 120 and permits the wearer to modify dimensions of upper 120 to accommodate proportions of the foot. More particularly, lace 154 permits the wearer to tighten upper 120 around the foot, and lace 154 permits the wearer to loosen upper 120 to facilitate entry and removal of the foot from the void (i.e., through throat opening 140). In addition, a tongue 152 extends through instep area 150 from a forward portion of upper 120 in forefoot region 10 to a top portion of upper 120 adjacent to throat opening 140 in heel region 14. In this embodiment, tongue 152 extends under lace 154 to enhance the comfort of article 100. In addition to, or in alternative of lace apertures 156, article 100 may include other lace-receiving elements, such as D-rings, hooks, or various looped tensile strands. In further configurations, upper 120 may include additional elements, such as (a) a heel counter in heel region 14 that enhances stability, (b) a toe guard in forefoot region 10 that is formed of a wear-resistant material, and (c) logos, trademarks, and placards with care instructions and material information.

Many conventional footwear uppers are formed from multiple material elements (e.g., textiles, polymer foam, polymer sheets, leather, synthetic leather) that are joined through stitching or bonding, for example. In contrast, in some embodiments, a majority of upper 120 is formed from a knitted component 130, which will be discussed in more detail below. Knitted component 130 may, for example, be manufactured through a flat knitting process and extends through each of each of forefoot region 10, midfoot region 12, and heel region 14, along both lateral side 16 and medial side 18, over forefoot region 10, and around heel region 14. In an exemplary embodiment, knitted component 130 forms substantially all of upper 120, including exterior surface 121 and a majority or a relatively large portion of interior surface 122, thereby defining a portion of the void within upper 120. In some embodiments, knitted component 130 may also extend under the foot. In other embodiments, however, a strobel sock or thin sole-shaped piece of material is secured to knitted component 130 to form a base portion of upper 120 that extends under the foot for attachment with sole structure 110.

In some embodiments, knitted component 130 may be formed from multiple knitted components. In an exemplary embodiment, knitted component 130 may include a body portion 124 and a heel portion 126. In some embodiments, body portion 124 may be formed from a knitted textile material and may extend along article 100 in a longitudinal direction from forefoot region 10 of upper 120 through midfoot region 12 and extending over a vamp portion of upper 120 that corresponds with an instep of a foot of a wearer. In an exemplary embodiment, at least a portion of body portion 124 may further extend rearwards from midfoot region 12 into heel region 14. Additionally, body portion 124 may extend continuously between lateral side 16 and medial side 18 around forefoot region 10 of upper 120. With this configuration, body portion 124 of knitted component 130 may be configured to substantially cover a foot of a wearer.

In some embodiments, heel portion 126 may be formed from a knitted textile material and may extend along article 100 in a vertical direction in heel region 14 from sole structure 110 towards the top of throat opening 140. In an exemplary embodiment, heel portion 126 may further extend at least partially into midfoot region 12 of upper 120 along the longitudinal direction of article 100. Additionally, heel portion 126 may extend continuously between lateral side 16 and medial side 18 around heel region 14 of upper 120. With this configuration, heel portion 126 of knitted component 130 may be configured as a cuff to cover at least a portion of an ankle of the wearer. Together, body portion 124 and heel portion 126 may be joined along corresponding edges to form knitted component 130, as will be described in more detail below.

In addition to covering the foot, therefore, upper 120 extends upward and covers a portion of the ankle. For reference purposes, upper 120 may be divided into two general regions: a foot region 20 and an ankle region 30, as shown in FIGS. 1, 2, and 3. Foot region 20 extends through each of forefoot region 10, midfoot region 12, and heel region 14 and generally encompasses portions of upper 120 corresponding with the foot. In many configurations of article 100, foot region 20 corresponds with portions of upper 120 that are intended to be below the lateral malleolus and the medial malleolus (i.e., the bony prominences on each side of the ankle) of the wearer. Ankle region 30 is primarily located in heel region 14 and generally encompasses portions of upper 120 corresponding with the ankle. In many configurations of article 100, ankle region 30 corresponds with portions of upper 120 that are intended to cover and extend above the lateral malleolus and the medial malleolus, including a cuff.

Figure 4:
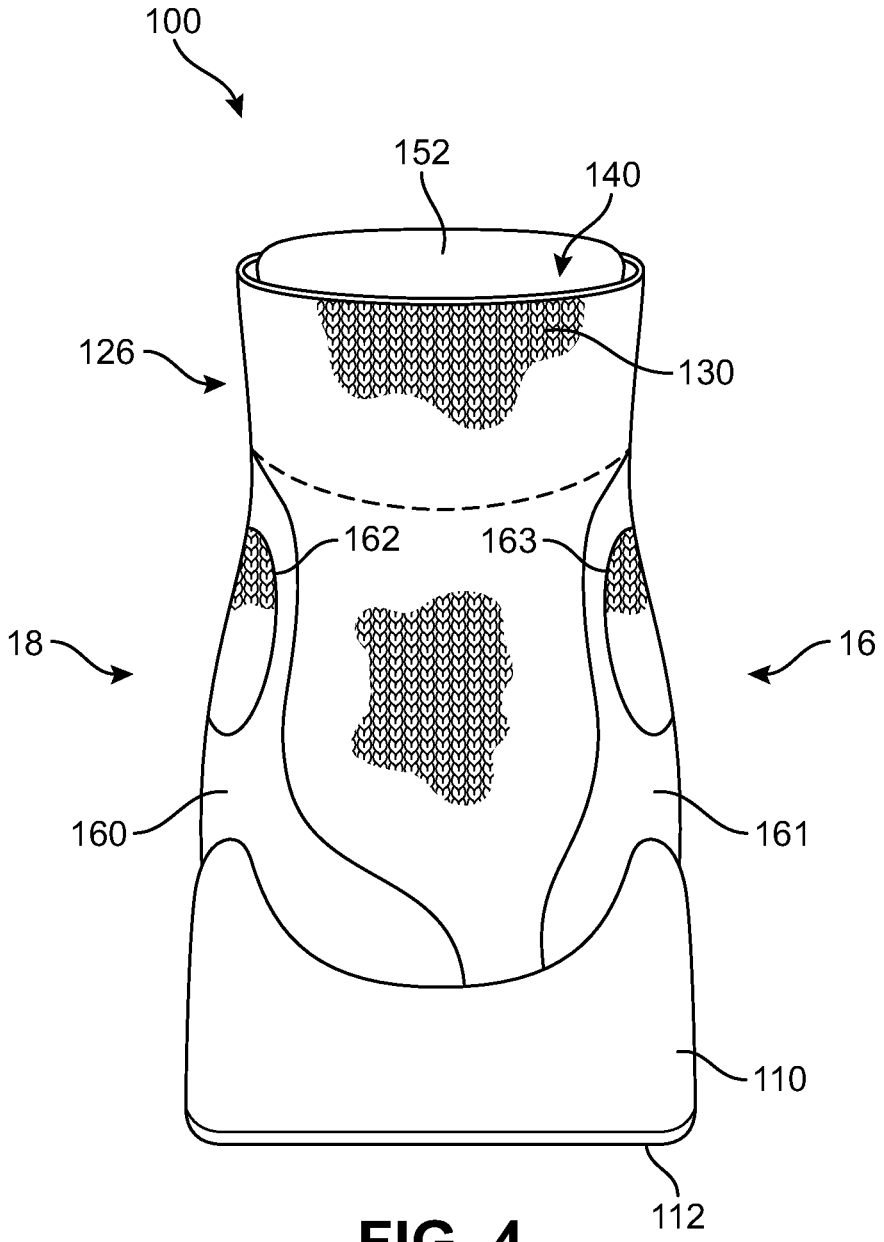
FIG. 4 is a rear view of an exemplary embodiment of an article of footwear.

In this embodiment, body portion 124 of knitted component 130 is primarily and substantially associated with foot region 20 of upper 120 and heel portion 126 is associated with at least a portion of foot region 20 and a substantial majority of ankle region 30. As seen in FIG. 4, heel portion 126 extends from a lower area of upper 120 adjacent to sole structure 110 to a top edge of upper 120 extending around throat opening 140. In some embodiments, heel portion 126 extends upwards above an ankle of a foot of a wearer when disposed within article 100 to form a cuff. In an exemplary embodiment, heel portion 126 may be joined or attached to body portion 124 along adjacent edges that extend approximately from instep area 150 in a downwards direction towards sole structure 110. In addition, in some embodiments, heel portion 126 and body portion 124 may be joined or attached along adjacent edges that extend in an approximately diagonal direction from instep area 150 towards a rear of article 100 at heel region 14.

In some embodiments, article 100 may be provided with provisions for enhancing the flexibility between foot region 20 and ankle region 30 of upper 120. For example, in cases where upper 120 includes heel portion 126 that wraps around an ankle to form a cuff, article 100 may include provisions to allow the ankle to move forwards and rearwards with respect to the foot. In an exemplary embodiment, upper 120 of article 100 may include one or more flex notches that are configured to facilitate increased flexibility for heel portion 126 in ankle region 30 of upper 120, which may facilitate leaning forwards and rearwards during basketball or other maneuvers or activities.

In an exemplary embodiment, heel portion 126 of knitted component 130 may be provided with a flex notch in the form of a cut-out portion in the front perimeter edges along each of lateral side 16 and medial side 18 of upper 120. In one embodiment, flex notches may have an approximately triangular shape. In other embodiments, flex notches may have any other suitable shape, including, but not limited to rounded shapes (such as circular or oval shapes), polygonal shapes (such as triangular, rectangular, pentagonal, etc.), regular shapes, irregular shapes, or any other types of shapes.

In this embodiment, heel portion 126 of knitted component 130 includes a medial notch 128 and a lateral notch 129 on the respective medial side 18 and lateral side 16 of article 100. In one embodiment, flex notches, including medial notch 128 and/or lateral notch 129, may be provided on upper 120 at locations that are near the transition between foot region 20 and ankle region 30. With this configuration, the flex notches, including medial notch 128 and/or lateral notch 129, may assist with flexibility of article 100 and facilitate forward and rearward movement or pivoting at the ankle of the wearer relative to the foot. In this embodiment, flex notches are provided on heel portion 126, however, in other embodiments, one or more flex notches may be provided on body portion 124 at a location near the transition between foot region 20 and ankle region 30 of upper 120.

In some embodiments, article 100 may include one or more components that provide reinforcement to areas of upper 120. In an exemplary embodiment, upper 120 may include an overlay element that provides reinforcement to selected areas of knitted component 130. As shown in FIGS. 1 through 5, upper 120 includes overlay elements, including a medial overlay element 160 and a lateral overlay element 161 disposed on respective medial side 18 and lateral side 16, that cover selected areas of knitted component 130, including portions of body portion 124 and heel portion 126. Overlay elements, including medial overlay element 160 and/or lateral overlay element 161, may be made from any suitable material. Examples of materials for overlay elements include, but are not limited to: thermoplastic polyurethane (TPU), nylon, natural leather, synthetic leather, natural rubber or synthetic rubber.

In some embodiments, an overlay element may be provided with an opening that corresponds with a portion of a foot of wearer. For example, in this embodiment, medial overlay element 160 includes an ankle opening 162 and lateral overlay element 161 includes an ankle opening 163 that provides a space or gap in the overlay element to accommodate the respective lateral or medial malleolus of the foot of a wearer when article 100 is worn. In an exemplary embodiment, ankle opening 162, 163 in overlay element 160, 161 assists with providing comport to the wearer by allowing knitted component 130 to stretch through ankle opening 162, 163 to correspond with and be substantially flush against the malleolus of the wearer on either side of the ankle. Overlay elements may also cover one or more seams joining portions of knitted component 130, as described in more detail below. Additionally, overlay elements may provide visual and/or aesthetic features to article 100.

Figure 5:
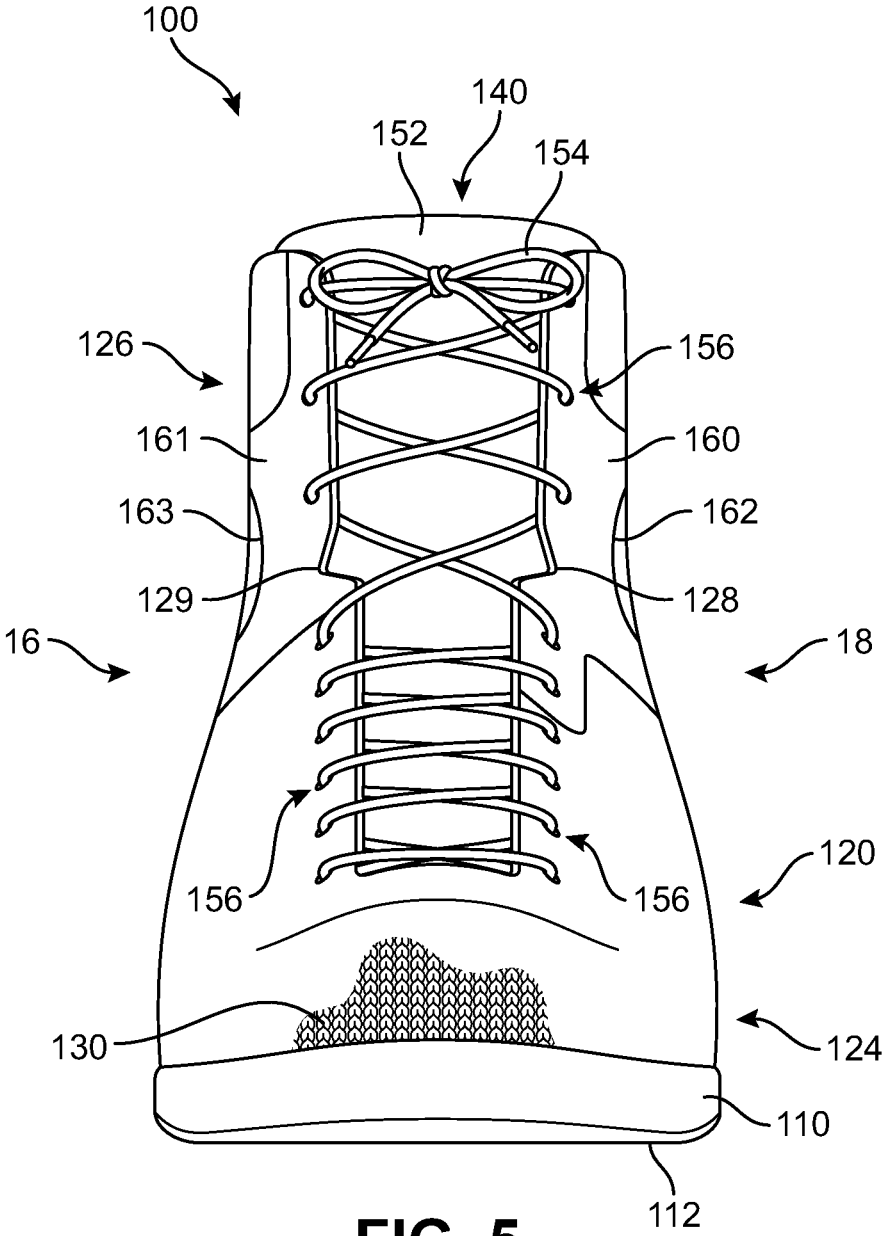
FIG. 5 is a front view of an exemplary embodiment of an article of footwear.

Referring now to FIG. 5, heel portion 126 forms a cuff having an approximately C-shape with front perimeter edges extending along opposite sides of instep area 150 to provide support for ankle of a wearer of article 100 by surrounding and substantially encircling the ankle of the wearer when disposed within upper 120 through throat opening 140. Heel portion 126 includes a top edge forming a cuff extending around throat opening 140 from lateral side 16 to medial side 18 in a continuous manner around heel region 14 at the back of article 100, as shown in FIG. 4, while remaining open along the front of article 100 at instep area 150 to accommodate tongue 152. In an exemplary embodiment, tongue 152 may fit between opposite front perimeter edges of heel portion 126. Additionally, flex notches, including medial notch 128 and lateral notch 129, are shown on opposite sides of instep area 150.

As described above, in some embodiments, upper 120 may incorporate knitted component 130 that extends throughout upper 120 and forms a majority of exterior surface 121 and/or a majority of interior surface 122, thereby defining a portion of the void within upper 120. In an exemplary embodiment, upper 120 incorporates knitted component 130 that includes multiple knitted component portions, including body portion 124 and heel portion 126. Referring now to FIGS. 6 through 11, knitted component 130 and respective portions, including body portion 124 and heel portion 126, are depicted individually and separate from a remainder of article 100. Although a knitting process for manufacturing knitted component 130 and portions thereof will be discussed in greater detail below, knitted component 130 is formed from at least one yarn that is manipulated (e.g., with a knitting machine) to form a plurality of intermeshed loops that define a variety of courses and wales. That is, knitted component 130 has the structure of a knit textile.

Moreover, individual component portions of knitted component 130, including body portion 124 and/or heel portion 126, are each formed of unitary knit construction. Although seams may be present in the component portions of knitted component 130, a majority of the knitted component portions (e.g., body portion 124 and heel portion 126) have a substantially seamless configuration. As utilized herein, a knitted component portion (e.g., body portion 124 and/or heel portion 126 of knitted component 130) is defined as being formed of "unitary knit construction" when formed as a one-piece element through a knitting process. That is, the knitting process substantially forms the various features and structures of the knitted component portion without the need for significant additional manufacturing steps or processes. A unitary knit construction may be used to form a knitted component portion having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Although the respective knitted component portions forming knitted component 130 may be joined to each other (e.g., edges of body portion 124 and/or heel portion 126 being joined together) following the knitting process, each individual knitted component portion remains formed of unitary knit construction because it is formed as a one-piece knit element. Moreover, knitted component portions remain formed of unitary knit construction when other elements (e.g., a lace, logos, trademarks, placards with care instructions and material information, structural elements) are added following the knitting process.

Examples of various configurations of knitted components, including configurations that include an inlaid strand or tensile element, that may be used for one or more of the component portions of knitted component 130 are disclosed in U.S. Pat. No. 6,931,762 to Dua; U.S. Pat. No. 7,347,011 to Dua, et al.; U.S. Patent Application Publication 2008/0110048 to Dua, et al.; U.S. Patent Application Publication 2010/0154256 to Dua; and U.S. Patent Application Publication 2012/0233882 to Huffa, et al., the disclosures of each of which are entirely incorporated herein by reference.

Figure 6:
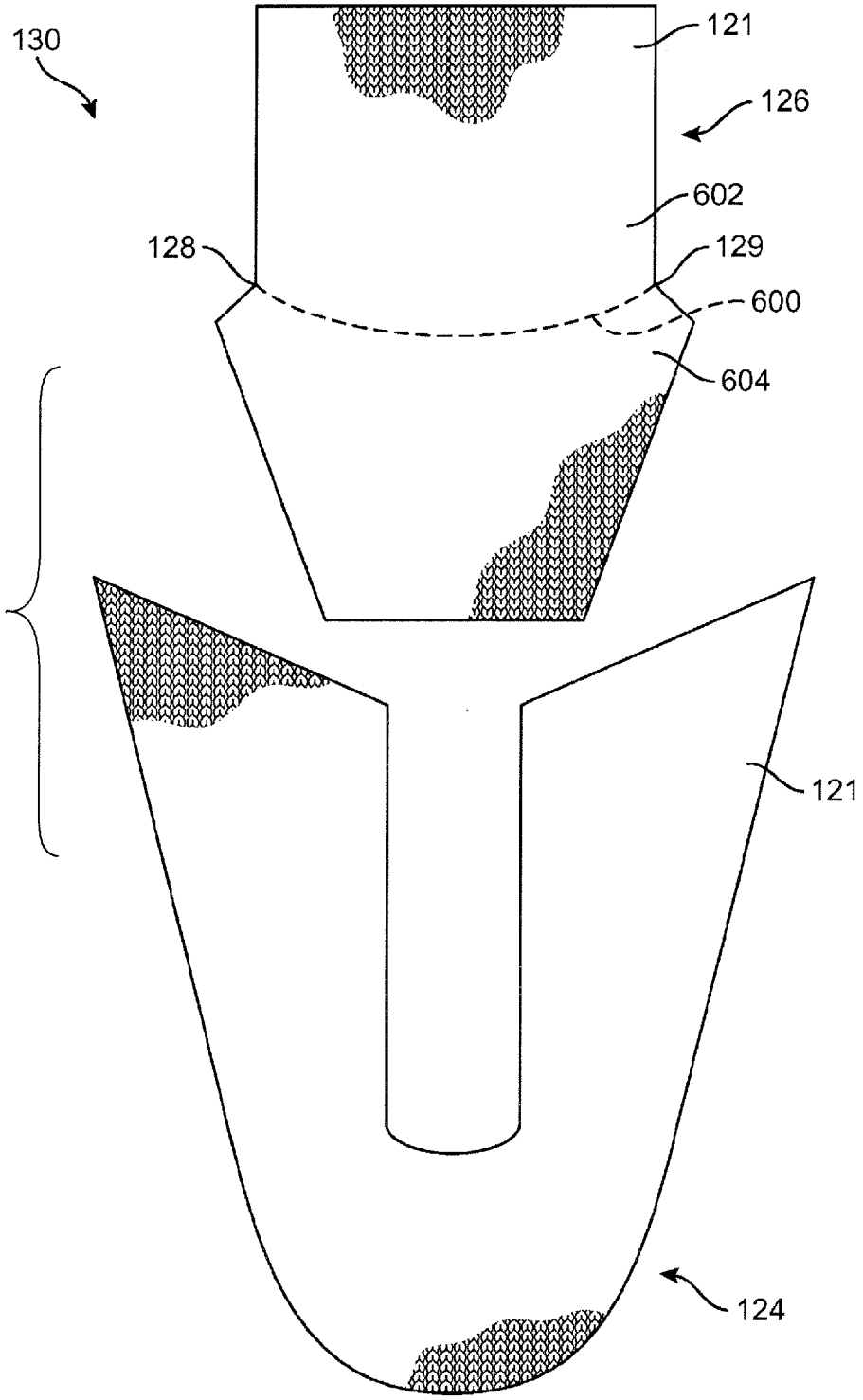
FIG. 6 is a top plan view of an exemplary embodiment of a knitted component incorporated into an upper of an article of footwear.

Although the configurations of knitted component 130 may vary in different embodiments, in an exemplary embodiment, knitted component 130 may be formed from multiple individual knitted component portions that are each formed of unitary knit construction. FIG. 6 illustrates one embodiment of knitted component 130 including two separate knitted component portions, body portion 124 and heel portion 126, that are joined along adjacent edges to form knitted component 130.

As shown in FIG. 6, knitted component 130 includes body portion 124 forming a portion of exterior surface 121 and opposite interior surface 122 of upper 120. Knitted component 130 further includes heel portion 126 that similarly forms a portion of exterior surface 121 and opposite interior surface 122 of upper 120. Together, body portion 124 and heel portion 126 may be joined together to form a substantial majority of exterior surface 121 and opposite interior surface 122 of upper 120.

Although a knitting process that forms knitted component 130 and/or the knitted component portions may be performed by hand, the commercial manufacture of multiple knitted components 130 and/or the knitted component portions, including body portion 124 and heel portion 126, will generally be performed by knitting machines. In general, knitting involves forming courses and wales of intermeshed loops of a yarn or multiple yarns. In production, knitting machines may be programmed to mechanically-manipulate one or more yarns into the configuration of a knitted component or a knitted component portion, for example, body portion 124 and heel portion 126. That is, respective portions of knitted component 130 may be formed by mechanically-manipulating one or more yarns to form a one-piece textile element that has the shape and features of body portion 124 and heel portion 126. As such, knitted component portions may be formed of unitary knit construction utilizing a knitting machine.

Although the respective portions of knitted component 130 may be formed through a variety of different knitting processes and using a variety of different knitting machines, flat knitting (i.e., the use of a flat knitting machine), including, but not limited to warp knitting or weft knitting, has the capability of forming knitted components 130 and/or knitted component portions, including body portion 124 and heel portion 126, to have the various features discussed above. In general, flat knitting involves forming a plurality of courses and wales. As an example, courses are rows of intermeshed loops of knit material that extend approximately laterally across each of body portion 124 and heel portion 126. Wales are columns of loops that extend perpendicular to the courses and extend generally along a length of each of body portion 124 and heel portion 126.

In other embodiments, circular knitting (i.e., the use of a circular knitting machine) may be used to form knitted components 130 and/or the knitted component portions, including body portion 124 and heel portion 126. Although general or conventional knitting processes may be used to form knitted components 130 and/or the knitted component portions, including body portion 124 and heel portion 126, specific examples of knitting processes that may be used include, but are not limited to: flat knitting, including warp or weft knitting, and circular knitting, including wide tube circular knitting, narrow tube circular knitting, narrow tube circular knit jacquard, single knit circular knit jacquard, double knit circular knit jacquard, and warp knit jacquard, for example.

Knitted component 130 may be formed from a single type of yarn that imparts common properties to each of the individual component portions, including body portion 124 and/or heel portion 126. In order to vary the properties of knitted component 130, however, different yarns may be utilized in different component portions of knitted component 130. That is, body portion 124 and/or heel portion 126, as well as different areas of body portion 124 and/or heel portion 126, may be formed from different yarns to vary the properties between portions or areas of knitted component 130. Moreover, one portion of knitted component 130 may be formed from a first type of yarn or combination of yarns that imparts a first set of properties, and another portion of knitted component 130 may be formed from a second type of yarn or combination of yarns that imparts a second set of properties. Properties may vary throughout the individual component portions of knitted component 130, therefore, by selecting specific yarns for different portions of knitted component 130. Examples of properties that may be varied through choice of yarn include color, pattern, luster, stretch, recovery, loft, hand, moisture absorption, biodegradability, abrasion-resistance, durability, and thermal conductivity. It should also be noted that two or more yarns may be utilized in combination to take advantage of properties from both yarns, such as when yarns are plated or form different courses in the same area.

The properties that a particular type of yarn will impart to a component portion of knitted component 130 or an area of body portion 124 and/or heel portion 126 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is durable, abrasion-resistant, and has relatively high strength. Polyester is a hydrophobic material that also provides relatively high durability. Yarns that incorporate thermoplastic materials may also permit portions or areas of knitted component 130 to be fused or stabilized through the application of heat. In addition to materials, other aspects of the yarns selected for portions or areas of knitted component 130 may affect properties. For example, a yarn forming knitted component 130, including body portion 124 and/or heel portion 126, may be a monofilament yarn or a multifilament yarn. The yarn may also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of knitted component 130 and the individual portions thereof. Accordingly, both the materials forming the yarn and other aspects of the yarn may be selected to impart a variety of properties to separate portions of knitted component 130 or areas of body portion 124 and/or heel portion 126.

In addition to the type of yarn that is selected for body portion 124 and/or heel portion 126 of knitted component 130, the knit structure in knitted component 130 imparts particular properties. As depicted, a majority of knitted component 130, including body portion 124 and/or heel portion 126, is formed to have a common or single knit structure, which is relatively untextured and may be referred to as a tubular or plain knit. In further configurations, however, portions of knitted component 130 may have a rib knit structure or mesh knit structure, or portions of knitted component 130 may have a hybrid knit structure in which multiple types of knit structures are utilized in one area. In order to vary the properties of body portion 124 and/or heel portion 126 of knitted component 130, different knit structures may be utilized in different portions of knitted component 130 or different areas of body portion 124 and/or heel portion 126. That is, body portion 124 and/or heel portion 126 or different areas of body portion 124 and/or heel portion 126 may be formed from different knit structures to vary the properties between portions or areas of knitted component 130.

Moreover, one portion of knitted component 130 may be formed from a first knit structure or combination of knit structures that imparts a first set of properties, and another portion of knitted component 130 may be formed from a second knit structure or combination of knit structures that imparts a second set of properties. Additionally, one area of body portion 124 and/or heel portion 126 may be formed from a first knit structure or combination of knit structures that impart the first set of properties, and another area of body portion 124 and/or heel portion 126 may be may be formed from a second knit structure or combination of knit structures that imparts the second set of properties. With this configuration, properties may vary throughout knitted component 130 by selecting specific knit structures for different portions or areas of knitted component 130. Examples of properties that may be varied through choice of yarn include pattern, luster, stretch, recovery, loft, hand, moisture absorption, abrasion-resistance, durability, and thermal conductivity.

Properties may be further varied by selecting both the type of yarn and the knit structure that is used in portions of knitted component 130 or areas of body portion 124 and/or heel portion 126. By combining various types of yarn with various knit structures, further combinations of properties may be imparted to knitted component 130. For example, a first type of yarn and a first knit structure may be utilized in one area of knitted component 130 to provide a set of properties, and a second type of yarn and a second knit structure may be utilized in a different area of knitted component 130 to provide a different set of properties. As an example, body portion 124 may incorporate types of yarn and knit structures that impart high stretch, and heel portion 126 may incorporate types of yarn and knit structures that impart loft and low stretch. Additionally, some portions of body portion 124 and/or heel portion 126 may have a rib knit structure with a higher denier yarn, and other portions of body portion 124 and/or heel portion 126 may have a plain knit structure with a lower denier yarn. Portions of body portion 124 may also incorporate types of yarn and knit structures wick moisture away from the foot. Accordingly, selecting particular combinations of types of yarn and knit structures for each portion of knitted component 130 or area of body portion 124 and/or heel portion 126 permits each portion or area to have a particular combination of beneficial properties.

In some embodiments, heel portion 126 may include areas having different properties. As discussed above, in various embodiments, areas of heel portion 126 may be provided with different properties by varying types of yarn, types of knit structures, and/or a combination of yarn types and knit structures. In an exemplary embodiment, a boundary 600 separates two areas on heel portion 126 having different properties. In this embodiment, boundary 600 demarcates where the properties associated with heel portion 126, for example, a stitch type, a yarn type, or characteristics associated with different stitch types or yarn types, including aesthetics, stretch, thickness, air permeability, and abrasion-resistance, may be varied from other areas on heel portion 126. It should be understood that in some cases, boundary 600 may be visibly indicated on heel portion 126 by virtue of differences in the knit structure or other indicia. In other cases, however, boundary 600 may not be visible on heel portion 126 and heel portion 126 may have a continuous appearance.

For example, as shown in FIG. 6, boundary 600 of heel portion 126 demarcates the transition on heel portion 126 between areas of different properties, including a first area 602 and a second area 604. In this embodiment, first area 602 has a generally elastic or stretchable property. In some cases, the generally elastic or stretchable property of first area 602 may be provided by using an elastic yarn to knit first area 602 of heel portion 126. In other cases, the generally elastic or stretchable property of first area 602 may be provided by use of a suitable knit structure that allows for increased stretch or elasticity. In still other cases, a combination of elastic yarn and suitable knit structure configured to provide increased stretch or elasticity may be used to form first area 602 of heel portion 126.

In an exemplary embodiment, second area 604 of heel portion 126 may have a generally inextensible or inelastic property that resists or is significantly non-stretch. In some cases, the generally inextensible or non-stretchable property of second area 604 may be provided by using an inelastic yarn to knit second area 604 of heel portion 126. In other cases, the generally inextensible or non-stretchable property of second area 604 may be provided by use of a suitable knit structure that prevents or reduces stretch or elasticity. In still other cases, a combination of inelastic yarn and suitable knit structure configured to prevent or reduce stretch or elasticity may be used to form second area 604 of heel portion 126.

By providing different areas of heel portion 126 of knitted component 130 with varying physical properties, the fit, comfort, and/or support provided by heel portion 126 of knitted component 130 to upper 120 may be varied as desired.

Figure 7:
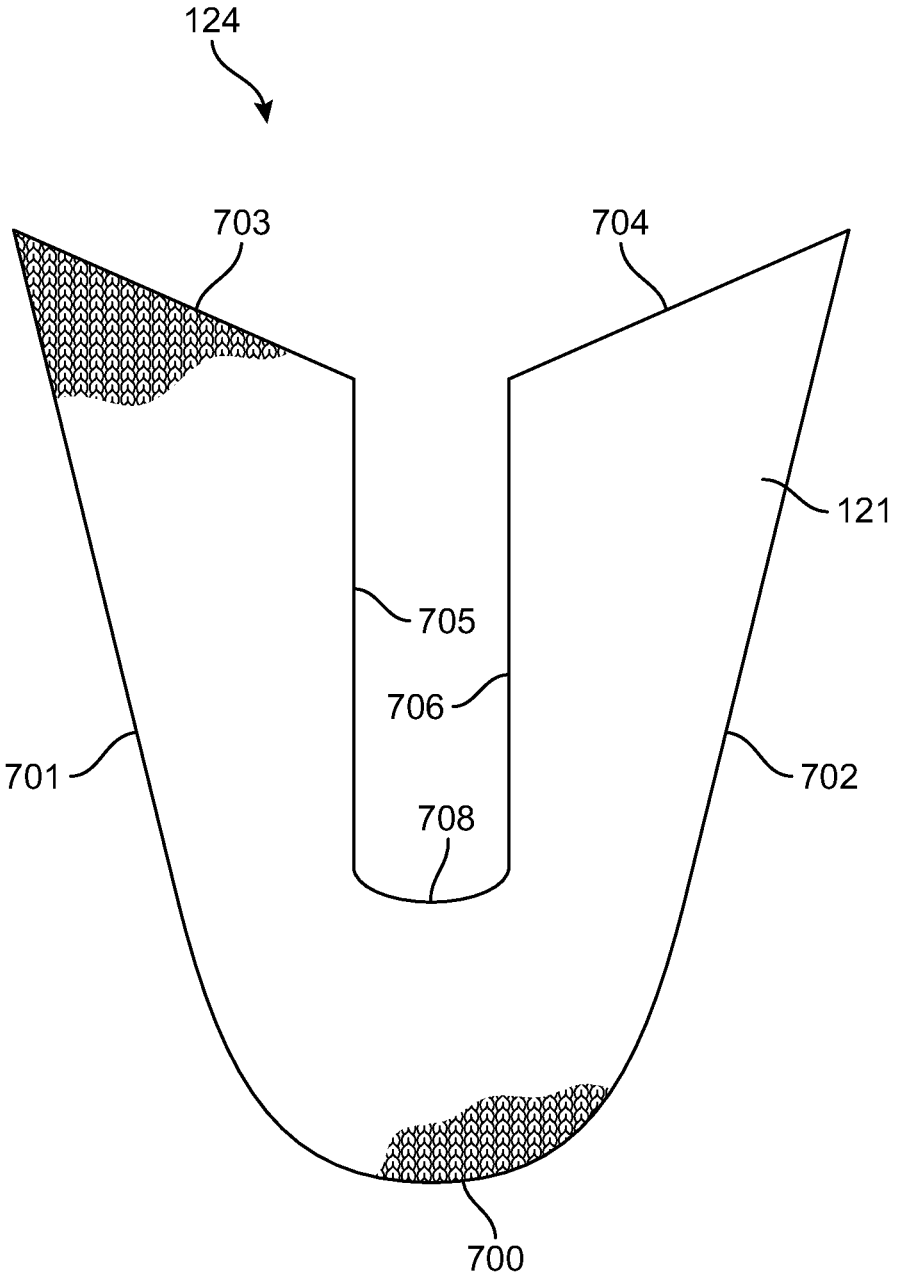
FIG. 7 is a top plan view of an exemplary embodiment of a body portion of the knitted component.

Each individual knitted component portion of knitted component 130 will now be described in more detail with reference to FIGS. 7 and 8. Referring now to FIG. 7, body portion 124 of knitted component 130 is shown in a planar or flat configuration. In this embodiment, body portion 124 has a generally U-shaped configuration that is outlined by an outer perimeter and an inner perimeter. In this embodiment, the outer perimeter includes a front perimeter edge 700, a lateral perimeter edge 701, and a medial perimeter edge 702 disposed opposite lateral perimeter edge 701. The outer perimeter edge of body portion 124 also includes a pair of rear edges, including a lateral rear edge 703 and a medial rear edge 704. In an exemplary embodiment, lateral rear edge 703 and medial rear edge 704 may be joined or attached with corresponding edges on heel portion 126 to form knitted component 130, as will be described in more detail below.

In an exemplary embodiment, body portion 124 may further include an inner perimeter that will be associated with and define instep area 150, described above. In this embodiment, the inner perimeter of body portion 124 includes lateral inner perimeter edge 705 and medial inner perimeter edge 706. Lateral inner perimeter edge 705 and medial inner perimeter edge 706 are disposed on opposite sides of body portion 124. Lateral inner perimeter edge 705 and medial inner perimeter edge 706 are spaced apart and define instep area 150 of upper 120. Additionally, the inner perimeter further includes forward edge 708. In embodiments where article 100 includes tongue 152 that extends through instep area 150, tongue 152 maybe joined or attached to upper 120 at forward edge 708 of body portion 124. When incorporated into an article of footwear, including article 100, front perimeter edge 700, lateral perimeter edge 701, and medial perimeter edge 702 of body portion 124 lay against an upper surface 111 (shown in FIG. 12) of sole structure 110 and may be joined to a strobel sock or sockliner.

In an exemplary embodiment, body portion 124 of knitted component 130 may be formed of unitary knit construction through a suitable knitting process. As described above, courses of knit material may extend in a first direction that is approximately laterally across body portion 124 between lateral perimeter edge 701 and medial perimeter edge 702. Additionally, wales of knit material may extend in a second direction that is approximately perpendicular to the courses and extend generally longitudinally along body portion 124 between front perimeter edge 700 towards the rear of body portion 124, including lateral rear edge 703 and medial rear edge 704.

Figure 8:
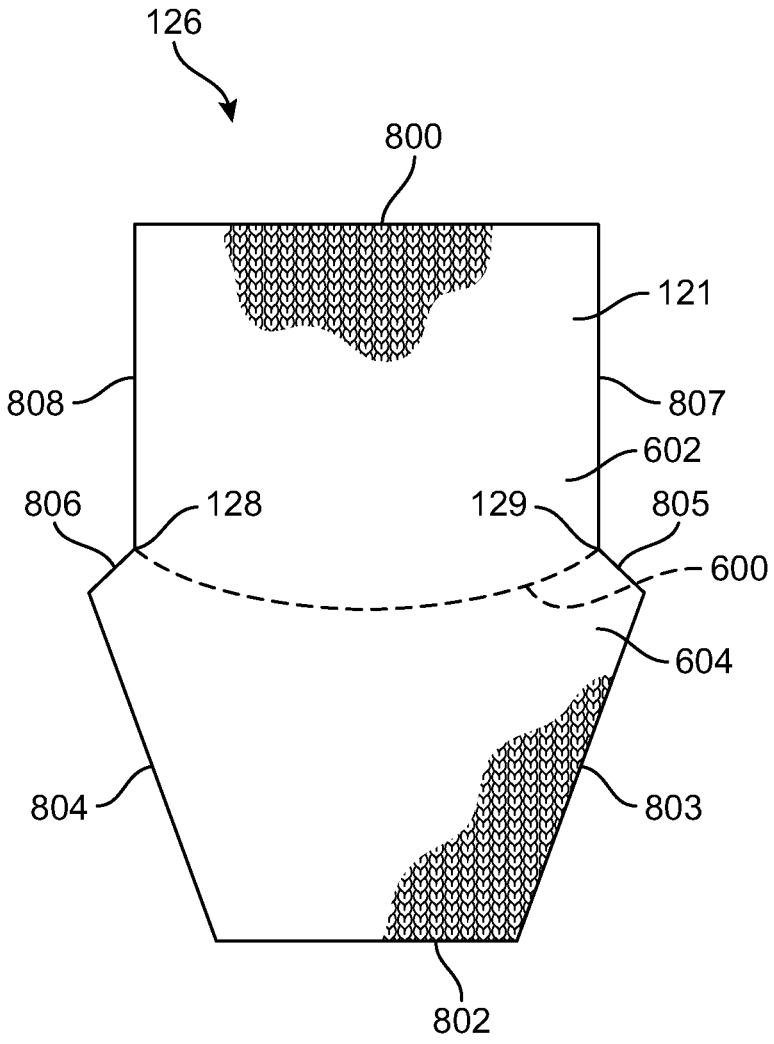
FIG. 8 is a top plan view of an exemplary embodiment of a heel portion of the knitted component.

Referring now to FIG. 8, heel portion 126 of knitted component 130 is shown in a planar or flat configuration. In some embodiments, heel portion 126 has a polygonal configuration that is outlined by a perimeter. In an exemplary embodiment, the configuration of heel portion 126 may resemble a keystone or wedge shape, with a generally rectangular area on top of angled side portions. In this embodiment, the perimeter includes a top perimeter edge 800 and an opposite bottom perimeter edge 802. The perimeter of heel portion 126 further includes angled portions disposed on each side, including a lateral lower angled edge 803 and a lateral upper angled edge 805 on one side of heel portion 126, and a medial lower angled edge 804 and a medial upper angled edge 806 on the opposite side. In an exemplary embodiment, lateral lower angled edge 803 and lateral upper angled edge 805 extend in different directions so as to form a peak or point at their juncture. Similarly, medial lower angled edge 804 and medial upper angled edge 806 also extend in different directions so as to form a peak or point at their juncture. As will be described in more detail below, medial lower angled edge 804 and lateral lower angled edge 803 may be joined or attached with corresponding edges on body portion 124 to form knitted component 130.

The perimeter of heel portion 126 further includes a pair of straight side edges extending upwards from each of lateral upper angled edge 805 and medial upper angled edge 806. In this embodiment, a medial side edge 808 extends upwards from medial upper angled edge 806 towards top perimeter edge 800 and a lateral side edge 807 extends upwards from lateral upper angled edge 805 towards top perimeter edge 800. In an exemplary embodiment, the juncture between medial side edge 808 and medial upper angled edge 806 defines medial notch 128 and the juncture between lateral side edge 807 and lateral upper angled edge 805 defines lateral notch 129. Additionally, in one embodiment, top perimeter edge 800 may be approximately perpendicular to medial side edge 808 and/or lateral side edge 807.

In an exemplary embodiment, heel portion 126 of knitted component 130 may be formed of unitary knit construction through a suitable knitting process. As described above, courses of knit material may extend in a first direction that is approximately laterally across heel portion 126 between lateral side edge 807, lateral upper angled edge 805, and lateral lower angled edge 803 and medial side edge 808, medial upper angled edge 806, and medial lower angled edge 804. Additionally, wales of knit material may extend in a second direction that is approximately perpendicular to the courses and extend generally vertically along heel portion 126 between bottom perimeter edge 802 towards top perimeter edge 800.

As noted above, in some embodiments different areas of heel portion 126 may be provided with varying physical properties. With this configuration, the fit, comfort, and/or support provided by heel portion 126 of knitted component 130 to upper 120 may be varied as desired. For example, as shown in FIG. 8, first area 602 having a generally elastic or stretchable property may be associated with an upper portion of heel portion 126 that is associated with the cuff extending around an ankle of a wearer in ankle region 30 of upper 120. In this embodiment, first area 602 extends upwards from boundary 600 towards top perimeter edge 800. In this embodiment, boundary 600 extends laterally across heel portion 126 and is approximately located between medial notch 128 and lateral notch 129. In an exemplary embodiment, boundary 600 may have a curved configuration. However, in other embodiments, boundary 600 may have a different configuration, including a straight or irregular line. Additionally, first area 602 extends laterally between medial side edge 808 and lateral side edge 807. With this configuration, the upper portion of heel portion 126 may be provided with additional or increased stretchability to facilitate fit, comfort, and/or support and stability to an ankle of a wearer.

In addition, as shown in FIG. 8, second area 604 having a generally inextensible or inelastic property may be associated with a lower portion of heel portion 126 that is configured to be attached to body portion 124 in foot region 20 of upper 120. In this embodiment, second area 604 extends downwards from boundary 600 towards bottom perimeter edge 802. Additionally, second area 604 extends laterally between lateral lower angled edge 803 and medial lower angled edge 804. With this configuration, the lower portion of heel portion 126 may be provided with resistance to stretch to facilitate fit, comfort, and/or support and stability to a foot and/or heel of a wearer. For example, in one embodiment, the generally inextensible or inelastic property of second area 604 of heel portion 126 may assist with keeping a heel and/or foot of the wearer restrained or in place during athletic movements.

Referring now to FIGS. 9 through 12, an exemplary process for joining or attaching the individual knitted component portions to form knitted component 130 for incorporating into upper 120 is described. It should be understood that process is merely exemplary and may include additional steps or processes that are not included or described. Similarly, the number and order of steps described in connection with the illustrated process is merely exemplary and may be performed in any suitable order to complete knitted component 130.

Figure 9:
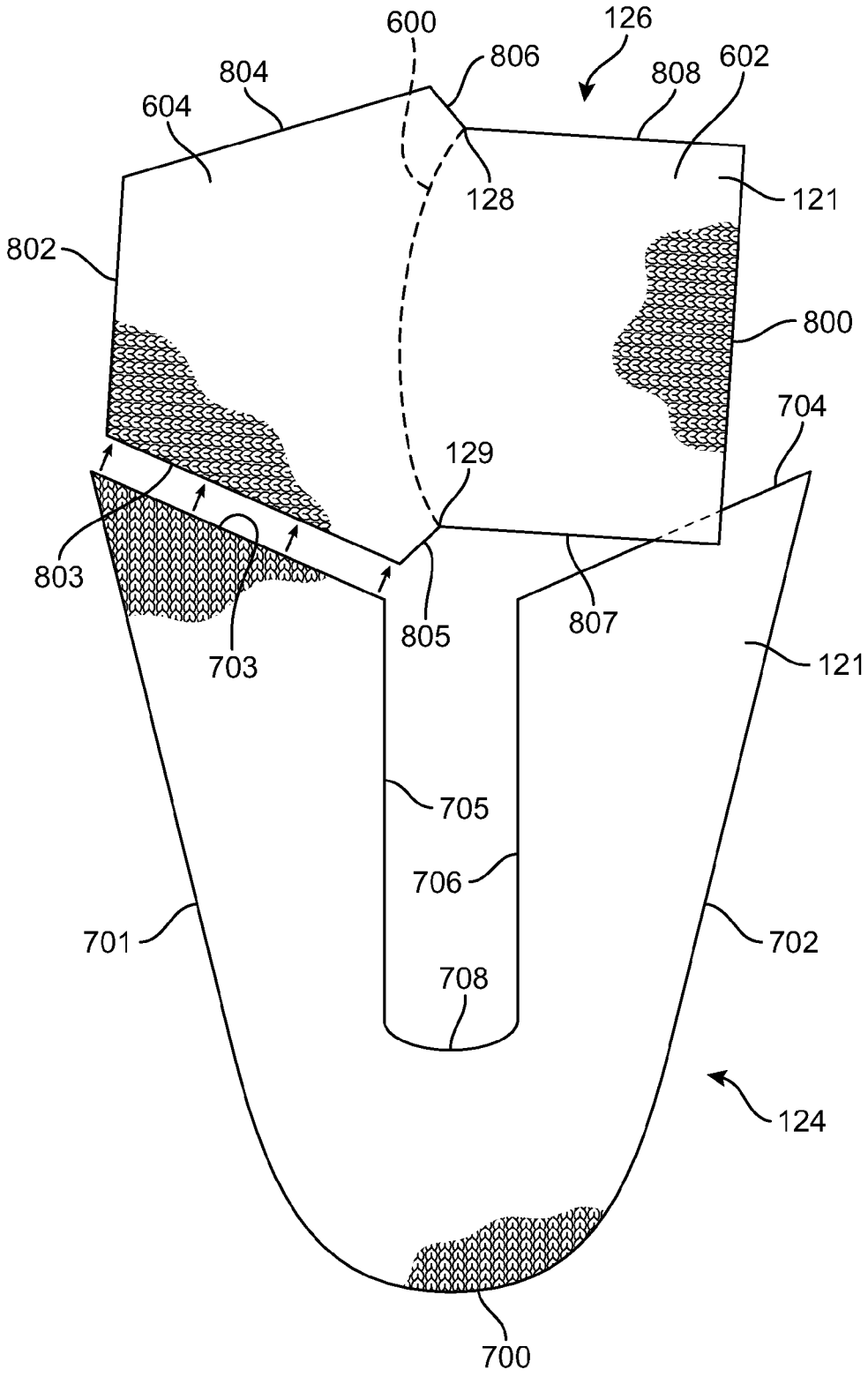
FIG. 9 is a schematic view of an exemplary process of assembling the knitted component for an upper of an article of footwear.

Referring now to FIG. 9, individual knitted component portions, including body portion 124 and heel portion 126, are joined along adjacent edges to form knitted component 130. In this embodiment, lateral rear edge 703 of body portion 124 may be aligned with lateral lower angled edge 803 of heel portion 126 so that lateral rear edge 703 and lateral lower angled edge 803 are adjacent and abutting. Upon joining or attaching lateral rear edge 703 and lateral lower angled edge 803, bottom perimeter edge 802 of heel portion 126 and lateral perimeter edge 701 of body portion 124 may be substantially continuous with each other.

Figure 10:
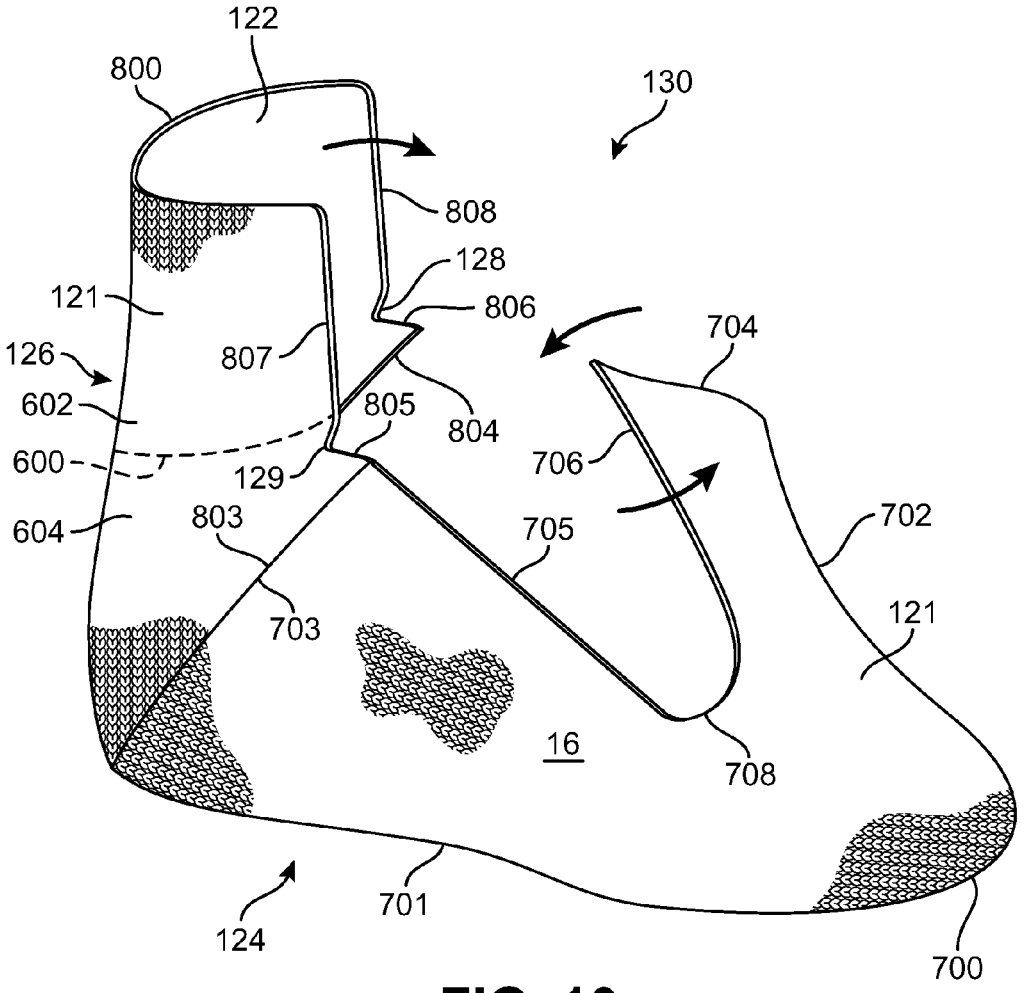
FIG. 10 is a schematic view of an exemplary process of joining portions of the knitted component.

Continuing to FIG. 10, heel portion 126 may be curled to form an approximate C-shape with medial lower angled edge 804 being moved to the opposite side from lateral lower angled edge 803. Similarly, medial rear edge 704 of body portion 124 is moved towards heel portion 126. In this embodiment, exterior surface 121 is facing outwards and away from knitted component 130 while interior surface 122 is facing inwards and towards knitted component 130. With this configuration, heel portion 126 extends substantially continuously around opposite sides to form the back of heel region 14 of knitted component 130.

Figure 11:
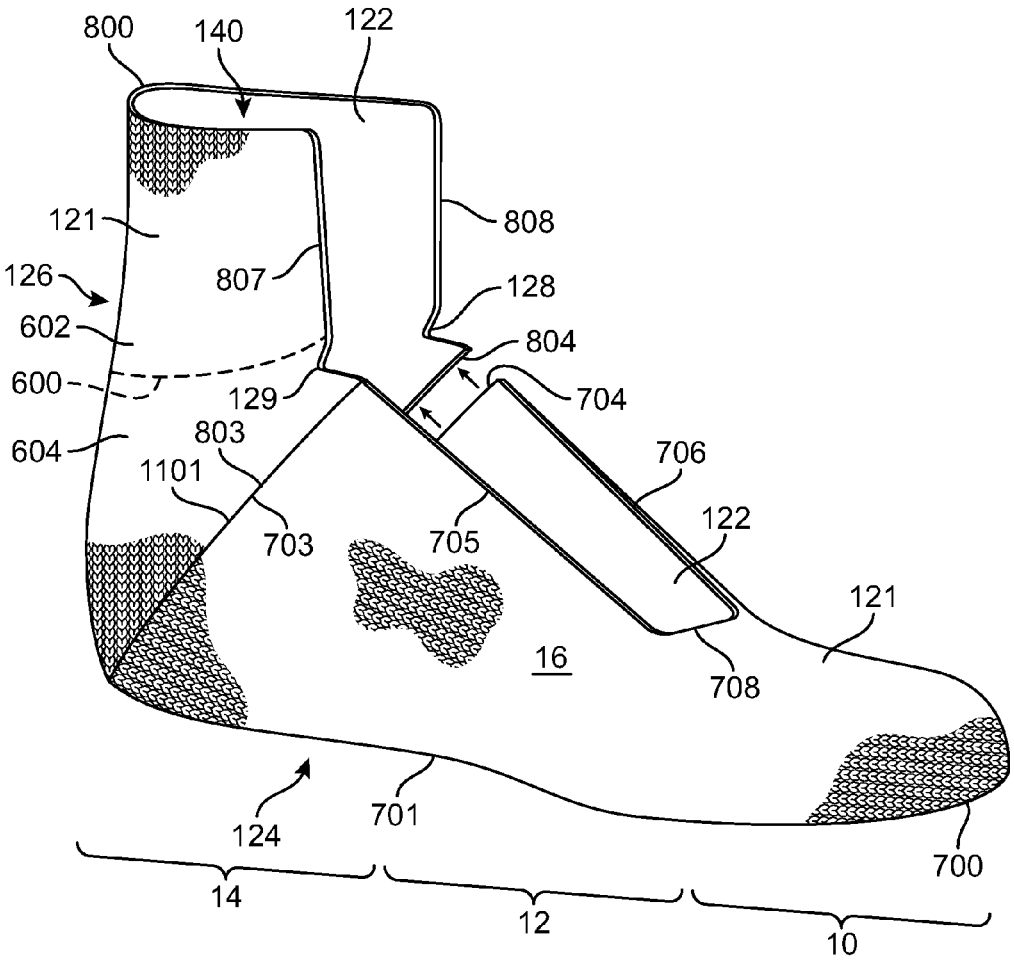
FIG. 11 is a schematic view of an exemplary process of joining portion of the knitted component to incorporate into an upper for an article of footwear.

Referring now to FIG. 11, medial rear edge 704 of body portion 124 is moved towards heel portion 126 and aligned with medial lower angled edge 804 so that medial rear edge 704 and medial lower angled edge 804 are adjacent and abutting. Upon joining or attaching medial rear edge 704 and medial lower angled edge 804, bottom perimeter edge 802 of heel portion 126 and medial perimeter edge 702 of body portion 124 may be substantially continuous with each other. With this configuration, knitted component 130 may be formed by joining body portion 124 and heel portion 126 along a medial seam 1100 between medial rear edge 704 and medial lower angled edge 804 on medial side 18 of knitted component 130 and along a lateral seam 1101 between lateral rear edge 703 and lateral lower angled edge 803 on lateral side 16 of knitted component 130.

Body portion 124 and heel portion 126 may be joined or attached along medial seam 1100 and/or lateral seam 1101 using any suitable method, including, but not limited to stitching, adhesive, seam tape, or any other suitable attachment mechanism. In an exemplary embodiment, body portion 124 and heel portion 126 are joined or attached along medial seam 1100 and/or lateral seam 1101 using stitching to form knitted component 130.

In some embodiments, the direction of knitting of body portion 124 and heel portion 126 may be different. In an exemplary embodiment, the knitting directions of body portion 124 and heel portion 126 are approximately perpendicular along medial seam 1100 and/or lateral seam 1101 of knitted component 130. Varying the knitting direction associated with the individual knitted component portions may allow the different knitted component portions of knitted component 130 to stretch or give along different directions or orientations. For example, because the knitting direction associated with heel portion 126 is aligned approximately along the vertical direction between top perimeter edge 800 and bottom perimeter edge 802 (i.e., courses of heel portion 126 extend laterally between lateral side 16 and medial side 18), heel portion 126 may experience or provide an amount or degree of stretch or give along the vertical direction as the individual loops of the knitted component portion are tensioned. Similarly, because the knitting direction associated with body portion 124 is aligned approximately along the longitudinal direction between front perimeter edge 700 and medial rear edge 704 and lateral rear edge 703 (i.e., courses of body portion extend laterally across between lateral side 16 and medial side 18), body portion may experience or provide an amount or degree of stretch or give along the longitudinal direction as the individual loops of the knitted component portion are tensioned.

Figure 12:
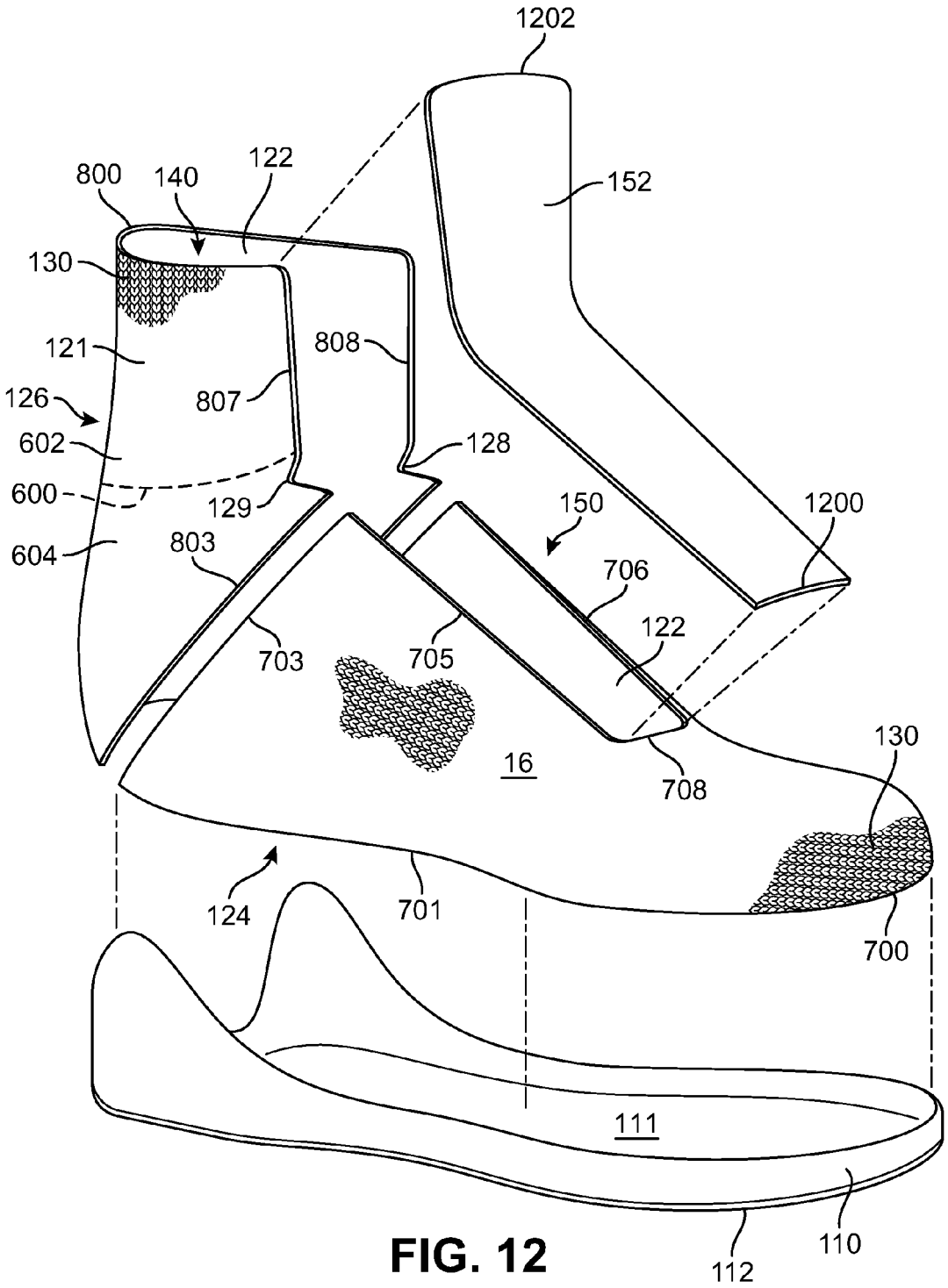
FIG. 12 is an exploded view of the components of an exemplary embodiment of an article of footwear with an upper incorporating a knitted component.

FIG. 12 illustrates an exploded view of knitted component 130 with additional elements that may be joined or attached to knitted component 130 to complete upper 120 and form article of footwear 100. In this embodiment, knitted component 130 may be joined with tongue 152 and sole structure 110, described above, to form article 100. In an exemplary embodiment, tongue 152 may be configured to extend through instep area 150 of knitted component 130 from a bottom end 1200 disposed adjacent to forward edge 708 of body portion 124 in forefoot region 10 to a top end 1202 disposed adjacent to top perimeter edge 800 of heel portion 126 at throat opening 140 of knitted component 130. In one embodiment, tongue 152 may be joined to knitted component 130 by attaching bottom end 1202 of tongue 152 at or near forward edge 708 of body portion 124 using any suitable attachment mechanism, including stitching or adhesive.

In an exemplary embodiment, knitted component 130 may be associated with a sole structure, including sole structure 110, to form article of footwear 100. When incorporated into an article of footwear, including article 100, front perimeter edge 700, lateral perimeter edge 701, and medial perimeter edge 702 of body portion 124, and bottom perimeter edge 802 of heel portion 126 form a substantially continuous outer perimeter of knitted component 130 that lays against upper surface 111 of sole structure 110 and may be joined to a strobel sock or sockliner.

Figure 13:
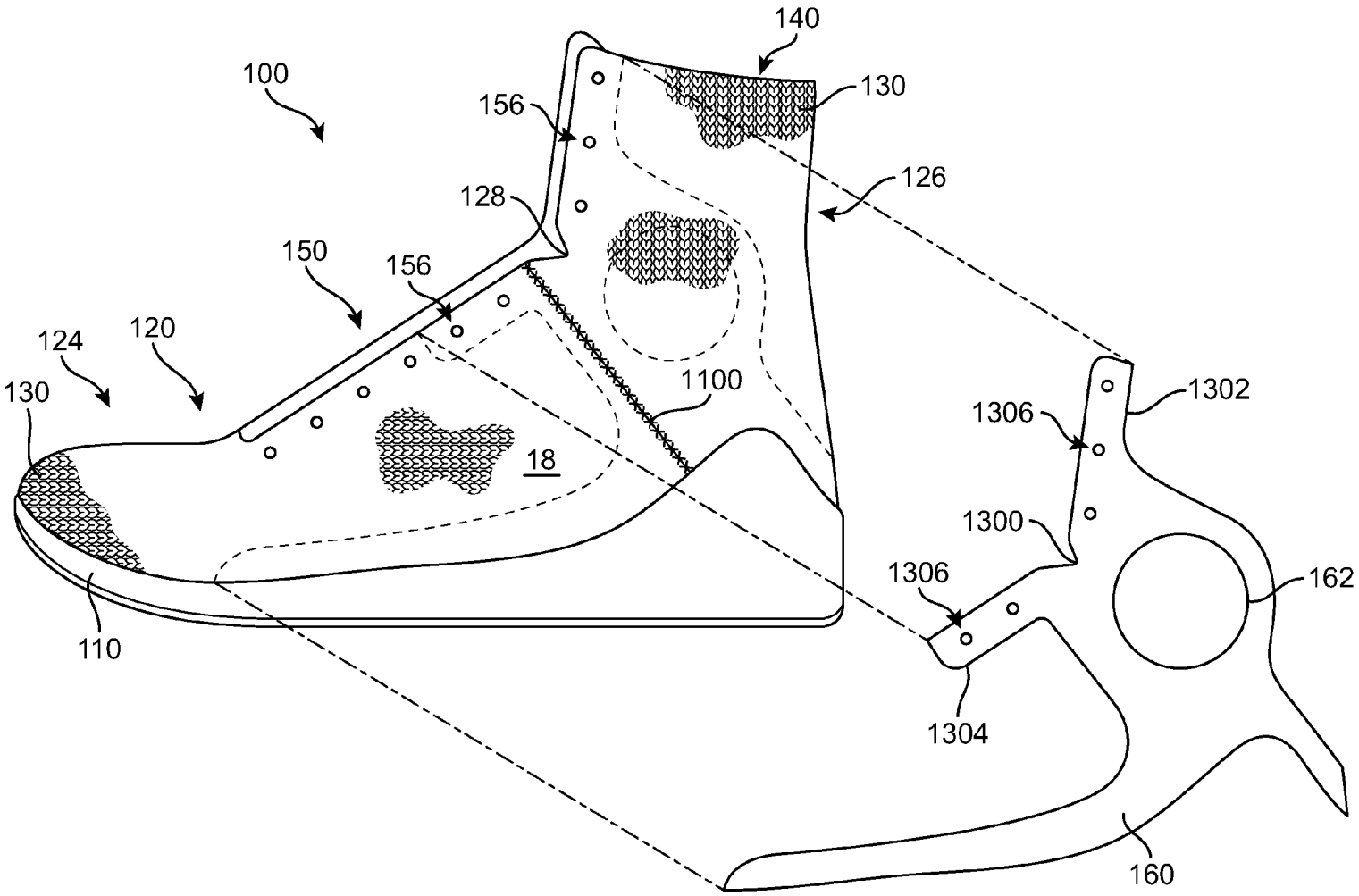
FIG. 13 is an exploded medial side view of an exemplary embodiment of an article of footwear including an overlay element.
Figure 14:
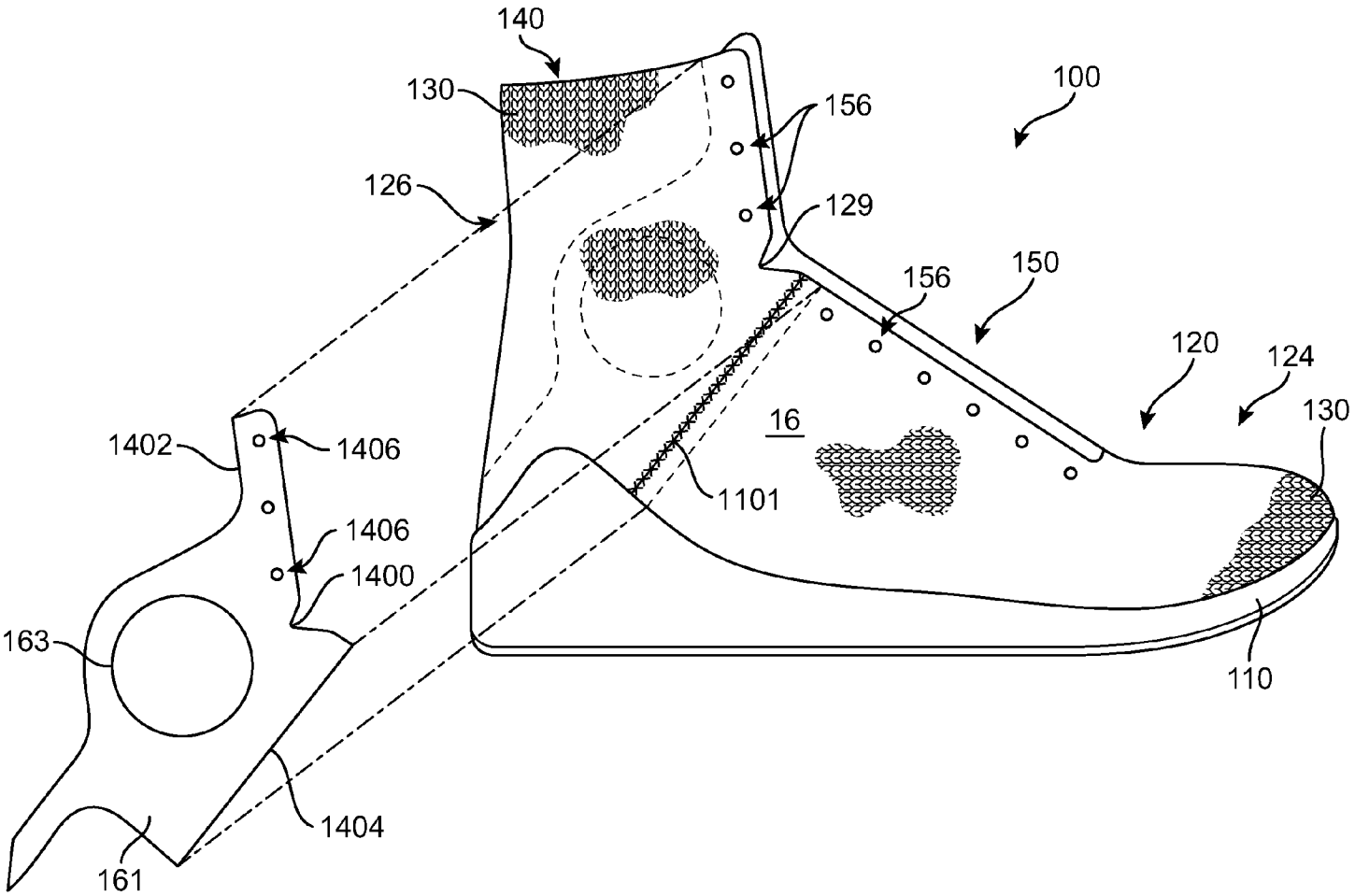
FIG. 14 is an exploded lateral side view of an exemplary embodiment of an article of footwear including an overlay element.

In some embodiments of an article of footwear, an overlay element may cover seams between body portion 124 and heel portion 126 to reinforce the seams and/or enhance the aesthetic appeal of the article of footwear. Referring now to FIGS. 13 and 14, in an exemplary embodiment, overlay elements, including medial overlay element 160 and/or lateral overlay element 161, described above, may be provided on knitted component 130 to cover medial seam 1100 and/or lateral seam 1101. In some embodiments, overlay elements may have asymmetrical configuration such that medial overlay element 160 and lateral overlay element 161 have different shapes and cover different areas of knitted component 130.

For example, in one embodiment shown in FIG. 13, medial overlay 160 may have a first shape that includes a upper portion 1302 that is configured to cover a portion of heel portion 126 adjacent to and extending along medial side edge 808 of heel portion 126 forming the front perimeter edge of knitted component 130 on medial side 18. In this embodiment, medial overlay 160 may further include a lower portion 1304 that is configured to cover a portion of body portion 124 adjacent to and extending along medial inner perimeter edge 706 of body portion 124. In an exemplary embodiment, medial overlay 160 further includes a notch 1300 between upper portion 1302 and lower portion 1304 that is configured to align with and correspond to the shape of medial notch 128 on knitted component 130. Additionally, in embodiments where upper 120 includes plurality of apertures 156 for receiving a lace, medial overlay 160 may further include corresponding apertures 1306 that are configured to align with and correspond to apertures 156. In this embodiment, medial overlay 160 includes apertures 1306 on both upper portion 1302 and lower portion 1304.

In contrast, as shown in FIG. 14, lateral overlay 161 may have a second shape that is different from the first shape of medial overlay 160. In this embodiment, lateral overlay 161 includes an upper portion 1402 that is configured to cover a portion of heel portion 126 adjacent to and extending along lateral side edge 807 of heel portion 126 forming the front perimeter edge of knitted component 130 on lateral side 16. In this embodiment, lateral overlay 161 may further include a lower portion 1404 that is configured to partially cover a small portion of body portion 124 adjacent to and extending partially along lateral inner perimeter edge 705 of body portion 124. Compared with medial overlay 160, lower portion 1404 of lateral overlay 161 does not extend as far along lateral inner perimeter edge 705 of body portion 124 as lower portion 1304 extends on medial inner perimeter edge 706.

In an exemplary embodiment, lateral overlay 161 further includes a notch 1400 between upper portion 1402 and lower portion 1404 that is configured to align with and correspond to the shape of lateral notch 129 on knitted component 130. Additionally, in embodiments where upper 120 includes plurality of apertures 156 for receiving a lace, lateral overlay 161 may further include corresponding apertures 1406 that are configured to align with and correspond to apertures 156. In this embodiment, lateral overlay 161 includes apertures 1406 only on upper portion 1402 and does not include any apertures 1406 on lower portion 1404. With this asymmetrical arrangement of medial overlay 160 and lateral overlay 161, overlay elements on knitted component 130 may be configured to provide a greater amount or degree of reinforcement to a selected area of upper 120 and/or knitted component 130. For example, by configuring medial overlay 160 with apertures 1306 on lower portion 1304, a greater degree or amount of reinforcement may be provided to medial side 18 of article 100 than on the opposite lateral side 16, where lateral overlay 161 includes only apertures 1406 on upper portion 1402.

In addition, as seen in FIGS. 13 and 14, medial seam 1100 and lateral seam 1101 joining body portion 124 and heel portion 126 on respective medial side 18 and lateral side 16 are configured to be located beneath the lateral and medial malleolus of an ankle of a wearer. In an exemplary embodiment, medial seam 1100 and lateral seam 1101 extend from along a lower area of upper 120 adjacent to sole structure 110 near heel region 14 in a vertically upward and longitudinally forward direction towards instep area 150 of upper 120. In this embodiment, medial seam 1100 and lateral seam 1101 extend approximately in a forward diagonal direction from the lower area of upper 120 at the outer perimeter of knitted component 130 that is contacting or adjacent to upper surface 111 of sole structure 110 to instep area 150 of upper 120. With this arrangement, the location of seams joining body portion 124 and heel portion 126 may approximately correspond with the transition between foot region 20 and ankle region 30 to assist with flexibility and movement of the ankle relative to the foot of the wearer. In other embodiments, however, the location of seams joining body portion 124 and heel portion 126 may vary.

Figure 15:
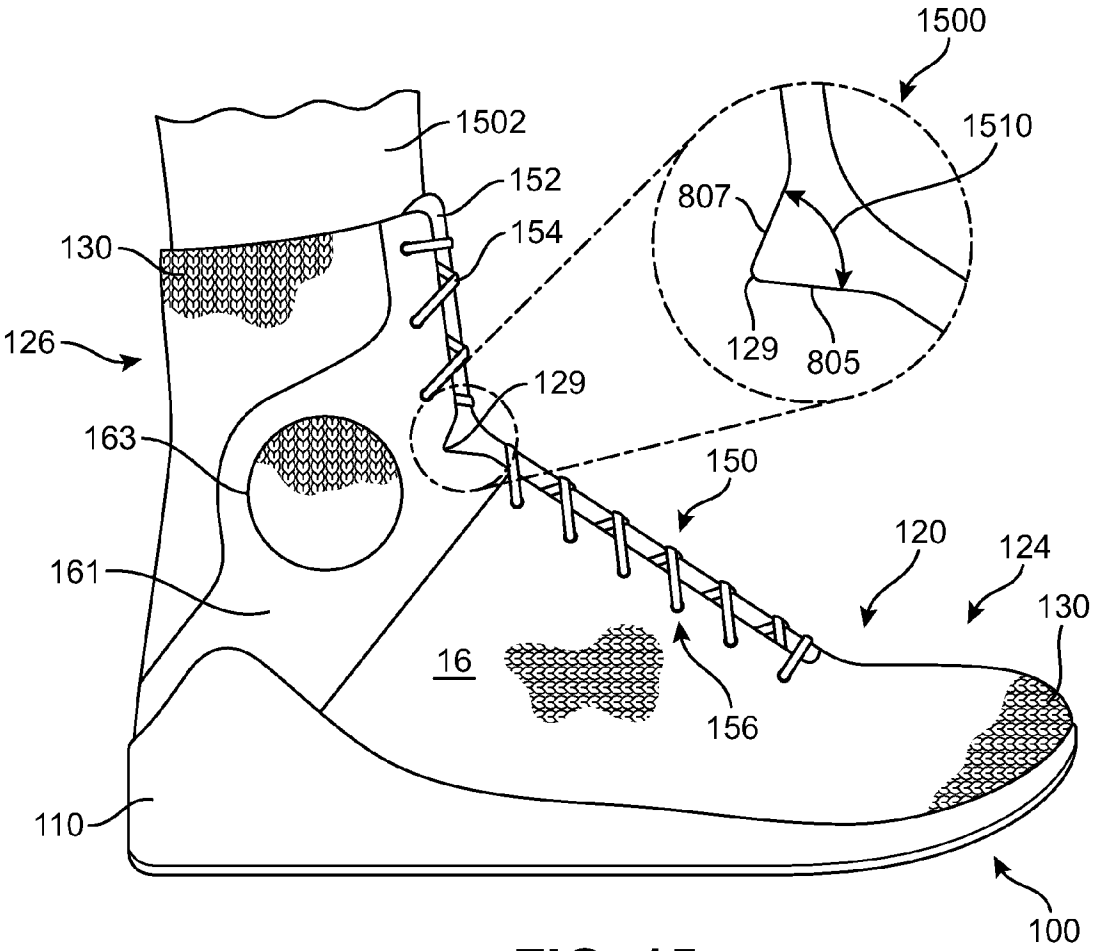
FIG. 15 is a representational view of an exemplary embodiment of an article of footwear with an upper incorporating a knitted component in a neutral configuration.
Figure 16:
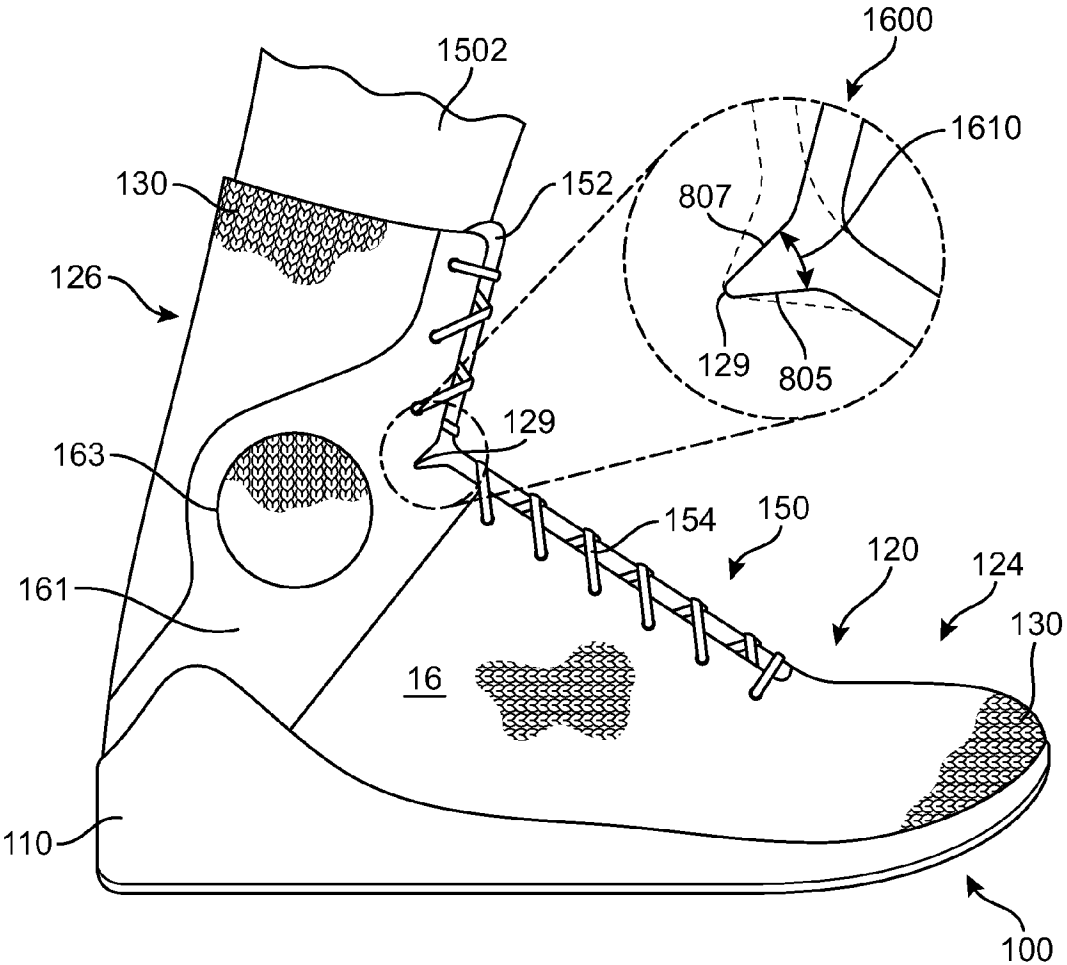
FIG. 16 is a representational view of an exemplary embodiment of an article of footwear with an upper incorporating a knitted component in a forward-leaning configuration.
Figure 17:
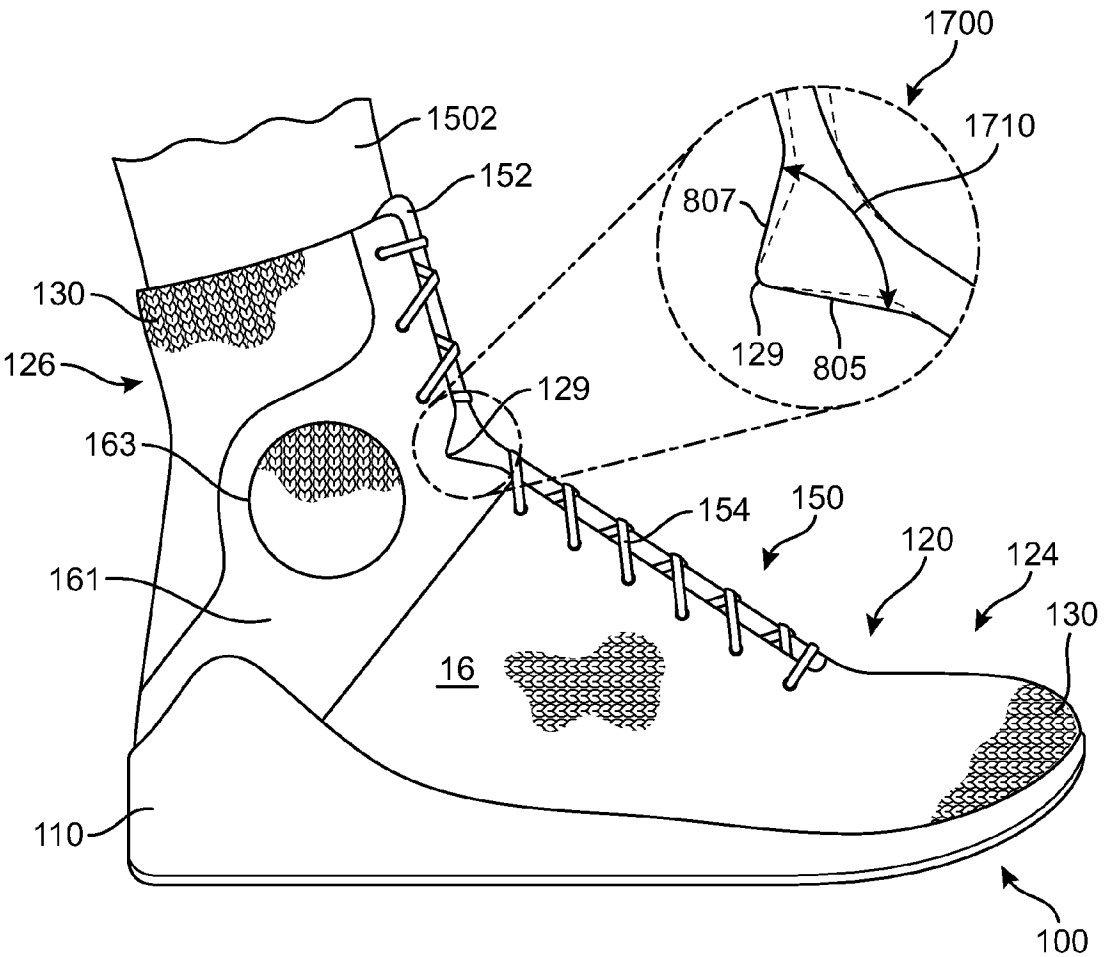
FIG. 17 is a representational view of an exemplary embodiment of an article of footwear with an upper incorporating a knitted component in a rearward-leaning configuration.

As previously discussed, upper 120 of article 100 may include one or more flex notches that are configured to facilitate increased flexibility for heel portion 126 in ankle region 30 of upper 120, which may facilitate leaning forwards and rearwards during basketball or other maneuvers or activities. Referring now to FIGS. 15 through 17, the function of flex notches, including medial notch 128 and/or lateral notch 129, assisting with leaning forwards and rearwards may be illustrated.

Referring now to FIG. 15, article 100 is shown with a foot 1502 of a wearer disposed within the interior void of upper 120. In this embodiment, article 100 may be in an original or neutral configuration 1500. In original or neutral configuration 1500, foot 1502 of the wearer is at an approximately perpendicular angle with respect to the ankle and is neither leaning forward or rearward. In this original configuration 1500, lateral notch 129 forms approximately a first angle 1510 between lateral side edge 807 and lateral upper angled edge 805.

Referring now to FIG. 16, article 100 is shown with foot 1502 as the wearer leans in a forward direction. In this embodiment, article 100 is in a forward leaning configuration 1600. In forward leaning configuration 1600, foot 1502 of the wearer is at an acute angle (i.e., less than 90 degrees) with respect to the ankle. Accordingly, in this forward leaning configuration 1600, the distance between lateral side edge 807 and lateral upper angled edge 805 defining lateral notch 129 is reduced, thereby forming approximately a second angle 1610. In this embodiment, second angle 1610 associated with forward leaning configuration 1600 is smaller than first angle 1510 associated with neutral configuration 1500.

Referring now to FIG. 17, article 100 is shown with foot 1502 as the wearer leans in a rearward direction. In this embodiment, article 100 is in a rearward leaning configuration 1700. In rearward leaning configuration 1700, foot 1502 of the wearer is at an obtuse angle (i.e., greater than 90 degrees) with respect to the ankle. Accordingly, in this rearward leaning configuration 1700, the distance between lateral side edge 807 and lateral upper angled edge 805 defining lateral notch 129 is increased, thereby forming approximately a third angle 1710. In this embodiment, third angle 1710 associated with rearward leaning configuration 1700 is larger than both first angle 1510 associated with neutral configuration 1500 and second angle 1610 associated with forward leaning configuration 1600.

It should be understood that medial notch 128 may have a substantially similar arrangement on medial side 18 for each of the various configurations discussed in FIGS. 15 through 17 as lateral notch 129. With this arrangement, lateral notch 129 and/or medial notch 128 assist heel portion 126 in ankle region 30 of upper 120 to move relative to body portion 124, which may facilitate leaning forwards and rearwards during basketball or other maneuvers or activities while wearing article 100.

In some embodiments of an article of footwear, alternate configurations of an overlay element may be provided with a different shape and/or geometry than medial overlay element 160 and/or lateral overlay element 161, described above. In an exemplary embodiment, an alternate configuration of an overlay element may have an opening or gap that corresponds to the flex notches on knitted component 130. With this alternate configuration, the flex notches on knitted component 130, including medial notch 128 and/or lateral notch 129, may be free from additional material of an overlay element so that increased or improved flexibility is provided.

Figure 18:
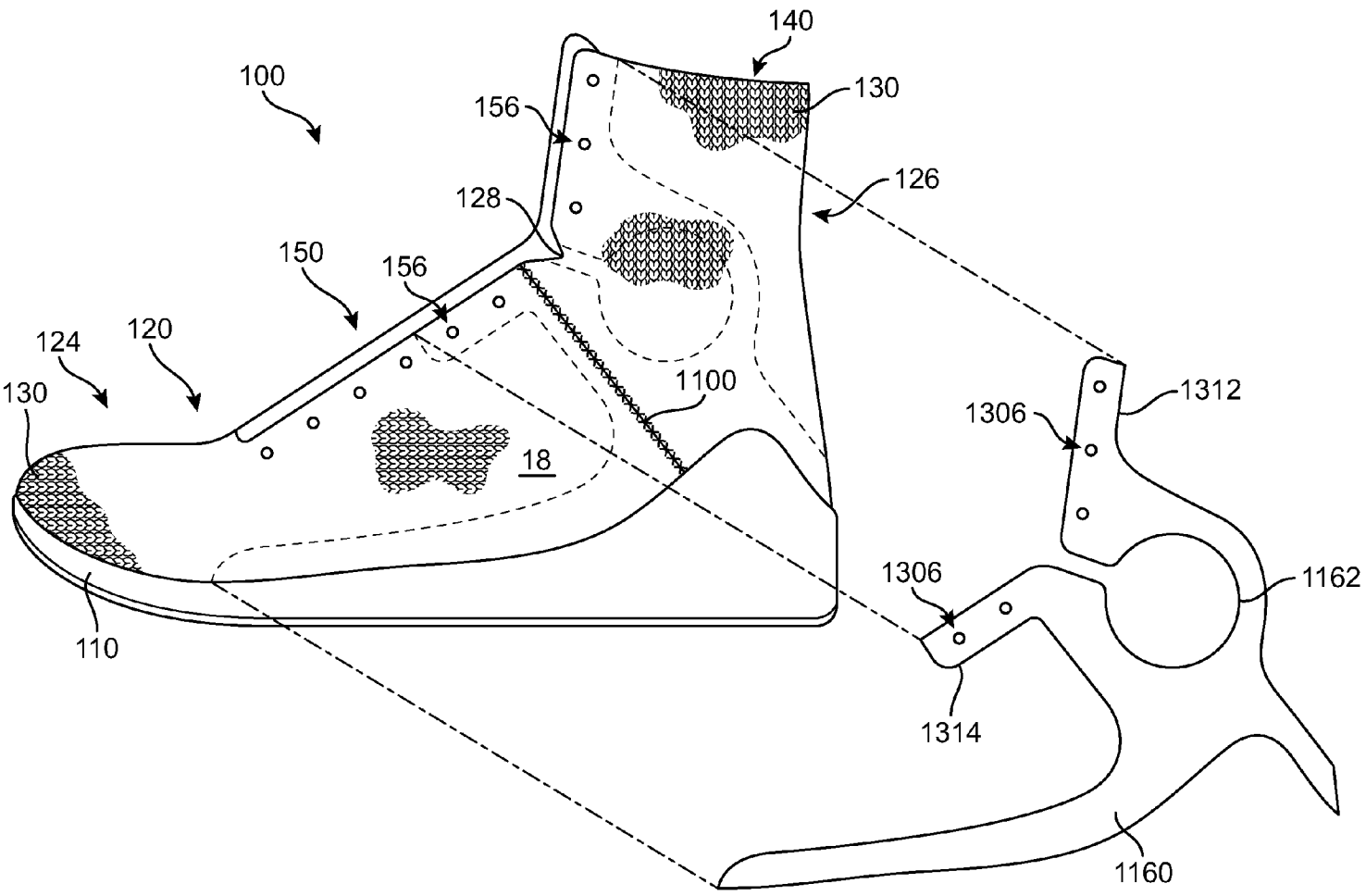
FIG. 18 is an exploded medial side view of an article of footwear including an alternate embodiment of an overlay element.
Figure 19:
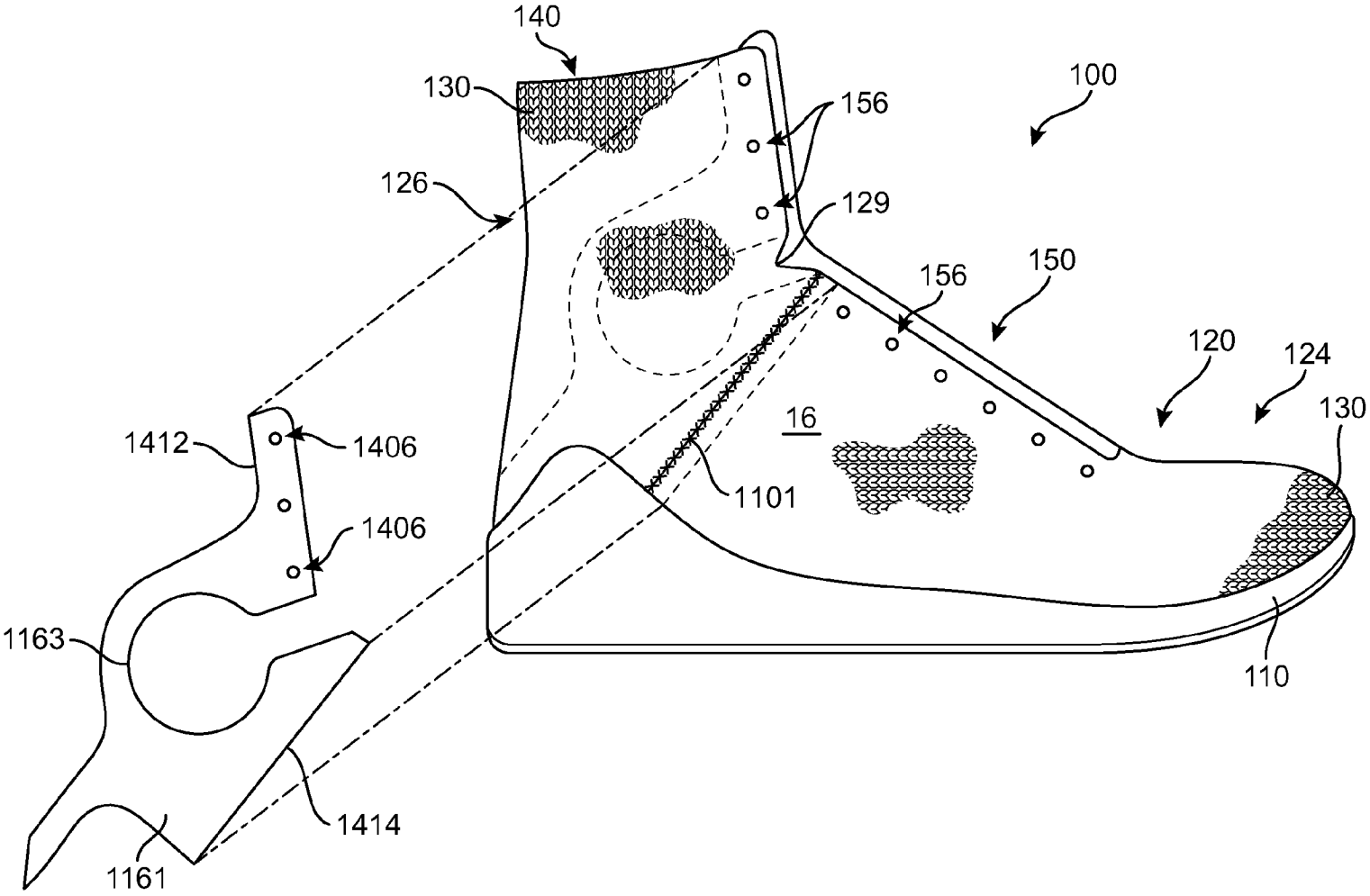
FIG. 19 is an exploded lateral side view of an article of footwear including an alternate embodiment of an overlay element.

Referring now to FIGS. 18 and 19, in an exemplary embodiment, overlay elements, including medial overlay element 1160 and/or lateral overlay element 1161, may be provided on knitted component 130 to cover medial seam 1100 and/or lateral seam 1101 in a substantially similar manner as described above with regard to overlay elements 160, 161. In some embodiments, overlay elements 1160, 1161 may have asymmetrical configuration such that medial overlay element 1160 and/or lateral overlay element 1161 have different shapes and cover different areas of knitted component 130, as with medial overlay element 160 and lateral overlay element 161, described above. However, in contrast with overlay elements 160, 161, the alternate configuration of overlay elements 1160, 1161 includes an opening or gap that corresponds with the respective flex notch on each side of knitted component 130.

For example, in one embodiment shown in FIG. 18, medial overlay 1160 may have a first shape that includes a upper portion 1312 that is configured to cover a portion of heel portion 126 adjacent to and extending along medial side edge 808 of heel portion 126 forming the front perimeter edge of knitted component 130 on medial side 18. In this embodiment, medial overlay 1160 may further include a lower portion 1314 that is configured to cover a portion of body portion 124 adjacent to and extending along medial inner perimeter edge 706 of body portion 124. In an exemplary embodiment, medial overlay 1160 includes an opening or gap between upper portion 1312 and lower portion 1314 that separates upper portion 1312 from lower portion 1314. In one embodiment, the opening or gap between upper portion 1312 and lower portion 1314 is configured to align with and correspond to medial notch 128 on knitted component 130 so that medial notch 128 is not covered by medial overlay 1160.

In some embodiments, medial overlay element 1160 may further include an ankle opening 1162 that provides a space or gap in the overlay element to accommodate the medial malleolus of the foot of a wearer when article 100 is worn. In an exemplary embodiment, ankle opening 1162 may be similar to ankle opening 162, described above. In this embodiment, ankle opening 1162 further includes the opening or gap separating upper portion 1312 and lower portion 1314. Additionally, in embodiments where upper 120 includes plurality of apertures 156 for receiving a lace, medial overlay 1160 may further include corresponding apertures 1306 that are configured to align with and correspond to apertures 156. In this embodiment, medial overlay 1160 includes apertures 1306 on both upper portion 1312 and lower portion 1314.

In contrast, as shown in FIG. 19, lateral overlay 1161 may have a second shape that is different from the first shape of medial overlay 1160. In this embodiment, lateral overlay 1161 includes an upper portion 1412 that is configured to cover a portion of heel portion 126 adjacent to and extending along lateral side edge 807 of heel portion 126 forming the front perimeter edge of knitted component 130 on lateral side 16. In this embodiment, lateral overlay 1161 may further include a lower portion 1414 that is configured to partially cover a small portion of body portion 124 adjacent to and extending partially along lateral inner perimeter edge 705 of body portion 124. Compared with medial overlay 1160, lower portion 1414 of lateral overlay 1161 does not extend as far along lateral inner perimeter edge 705 of body portion 124 as lower portion 1314 extends on medial inner perimeter edge 706.

In an exemplary embodiment, lateral overlay 1161 further includes an opening or gap between upper portion 1412 and lower portion 1414 that separates upper portion 1412 from lower portion 1414. In one embodiment, the opening or gap between upper portion 1412 and lower portion 1414 is configured to align with and correspond to lateral notch 129 on knitted component 130 so that lateral notch 129 is not covered by lateral overlay 1161.

In some embodiments, lateral overlay element 1161 may further include an ankle opening 1163 that provides a space or gap in the overlay element to accommodate the lateral malleolus of the foot of a wearer when article 100 is worn. In an exemplary embodiment, ankle opening 1163 may be similar to ankle opening 163, described above. In this embodiment, ankle opening 1163 further includes the opening or gap separating upper portion 1412 and lower portion 1414. Additionally, in embodiments where upper 120 includes plurality of apertures 156 for receiving a lace, lateral overlay 1161 may further include corresponding apertures 1406 that are configured to align with and correspond to apertures 156. In this embodiment, lateral overlay 1161 includes apertures 1406 only on upper portion 1412 and does not include any apertures 1406 on lower portion 1414.

With this asymmetrical arrangement of medial overlay 1160 and lateral overlay 1161, overlay elements on knitted component 130 may be configured to provide a greater amount or degree of reinforcement to a selected area of upper 120 and/or knitted component 130. In addition, by configuring medial overlay 1160 and lateral overlay 1161 with openings or gaps that correspond to the location of flex notches on knitted component 130, increased or improved flexibility may be provided to ankle region 30 relative to foot region 20 of upper 120.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. An article of footwear having an upper and a sole structure secured to the upper, the upper including a knitted component, the knitted component including: a body element forming a majority of the upper, the body element extending through a forefoot region, a midfoot region, and at least partially into a heel region of the article of footwear, the body element being formed of unitary knit construction; and a heel element forming a portion of the upper that extends above the body element, the heel element extending through the heel region and including a cuff that defines a throat opening within the upper for receiving a foot, the heel element being formed of unitary knit construction; wherein the body element and the heel element are joined along adjacent edges extending along each of a medial side and a lateral side of the upper to form the knitted component; and wherein the body element is joined to the heel element by a seam that extends from a lower area of the upper adjacent to the sole structure towards an instep area of the upper in a vertically upwards and forward direction, from the heel region toward the forefoot region, on each of the medial side and the lateral side; wherein the heel element further includes at least one flex notch located below the cuff and entirely outside of the body element; and wherein the at least one flex notch is separated from the sole structure by a first distance, and an uppermost point of the body element is separated from the sole structure by a second distance, and wherein the first distance is greater than the second distance.

2. The article of footwear according to claim 1, wherein the heel element has an approximate C-shape extending continuously around the heel region of the upper from the medial side to the lateral side.

3. The article of footwear according to claim 1, wherein the at least one flex notch comprises at least one of a lateral notch disposed on the lateral side of the heel element and a medial notch disposed on the medial side of the heel element.

4. The article of footwear according to claim 1, wherein the at least one flex notch facilitates forward and rearward movement of the cuff of the heel region relative to the body element of the knitted component.

5. The article of footwear according to claim 1, wherein a knitting direction of the body element and the heel element is different.

6. The article of footwear according to claim 1, wherein the heel element includes at least two areas having one or more of a different knit structure.

7. The article of footwear according to claim 6, wherein the at least two areas of the heel element comprise a first area associated with an upper portion of the heel element including a top perimeter edge and a second area associated with a lower portion of the heel element including a bottom perimeter edge.

8. The article of footwear according to claim 7, wherein the first area is formed with an elastic yarn and the second area is formed of an inelastic yarn.

9. An article of footwear having an upper and a sole structure secured to the upper, the upper including a knitted component, the knitted component including: a body element forming a majority of the upper, the body element extending through a forefoot region, a midfoot region, and at least partially into a heel region of the article of footwear, the body element being formed of unitary knit construction with a plurality of courses extending along a first knitting direction; and a heel element forming a portion of the upper that extends above body element, the heel element extending through the heel region and including a cuff that defines a throat opening within the upper for receiving a foot, the heel element being formed of unitary knit construction with a plurality of courses extending along a second knitting direction; wherein the heel element further includes at least one flex notch located below the cuff and located entirely outside of the body element; wherein the at least one flex notch is separated from the sole structure by a first distance, and an uppermost point of the body element is separated from the sole structure by a second distance, and wherein the first distance is greater than the second distance; wherein the body element and the heel element are joined along adjacent edges extending along each of a medial side and a lateral side of the upper to form the knitted component; wherein the body element comprises an outer perimeter edge that includes a pair of rear edges disposed on opposite sides of the upper; wherein the heel element includes a pair of lower angled edges disposed along opposite sides of the heel element; and wherein the pair of rear edges and the pair of lower angled edges are attached by a seam on each of the medial side and the lateral side; and wherein the seam extends from a lower area of the upper adjacent to the sole structure towards an instep area of the upper in a vertically upwards and forward direction, from the heel region toward the forefoot region, on each of the medial side and the lateral side; and wherein the first knitting direction and the second knitting direction are disposed in different directions at the adjacent edges joining the body element and the heel element.

10. The article of footwear according to claim 9, wherein the first knitting direction is approximately perpendicular to the second knitting direction along the adjacent edges.

11. The article of footwear according to claim 9, wherein the seam on each of the medial and lateral side of the upper is configured to be disposed below an ankle of a wearer.

12. The article of footwear according to claim 9, wherein the at least one flex notch facilitates forward and rearward movement of the cuff of the heel element relative to the body element of the knitted component.

13. An article of footwear having an upper and a sole structure secured to the upper, the upper including a knitted component formed of multiple knitted component portions, the knitted component including: a foot element extending through a forefoot region, a midfoot region, and a heel region of the article of footwear, the foot element including an instep area that extends between a medial side and a lateral side of the upper; an ankle element, wherein the entire ankle element extends outside of the foot region, the ankle element including a cuff that defines a throat opening for providing access to a void within the upper for receiving a foot; wherein the cuff extends continuously around the heel region of the upper between the medial side and the lateral side; wherein the foot element is joined to the ankle element by a seam that extends from a lower area of the upper adjacent to the sole structure towards an instep area of the upper in a vertically upwards and forward direction, from the heel region toward the forefoot region, on each of the medial side and the lateral side; wherein the ankle element further includes at least one flex notch located below the cuff and entirely outside of the foot element; and wherein the at least one flex notch is separated from the sole structure by a first distance, and an uppermost point of the body element is separated from the sole structure by a second distance, and wherein the first distance is greater than the second distance.

14. The article of footwear according to claim 13, wherein a knitting direction of the foot element and the ankle element is different.

15. The article of footwear according to claim 13, further comprising at least one overlay element disposed on an exterior surface of the knitted component; and wherein the at least one overlay element covers the seam.

16. The article of footwear according to claim 15, further comprising a first overlay element disposed on the medial side of the upper and a second overlay element disposed on the lateral side of the upper; and wherein the first overlay element and the second overlay element have different shapes.

17. The article of footwear according to claim 16, wherein the first overlay element comprises a lower portion extending over a portion of the foot element; and wherein the second overlay comprises an upper portion extending over a portion of the ankle element and a lower portion extending partially over the foot element.

18. The article of footwear according to claim 17, wherein the ankle element and the foot element for receiving a lace; and wherein the first overlay element includes corresponding apertures on each of the upper portion and the lower portion to align with the plurality of apertures on the medial side; and wherein the second overlay element includes corresponding apertures on the upper portion to align with the plurality of apertures on the lateral side.

19. The article of footwear according to claim 15, wherein the at least one overlay element includes an ankle opening.

* * * * *